US012662227B1

(12) United States Patent
Ahlswede et al.

(10) Patent No.: US 12,662,227 B1
(45) Date of Patent: Jun. 23, 2026

(54) TILLERS FOR CONTROLLING AN OPERATIONAL CHARACTERISTIC OF MARINE DRIVES

(71) Applicant: Brunswick Corporation, Mettawa, IL (US)

(72) Inventors: Scott G. Ahlswede, Plymouth, WI (US); Gary D. Needham, Stillwater, OK (US); Robert A. Podell, Slinger, WI (US)

(73) Assignee: Brunswick Corporation, Mettawa, IL (US)

( * ) Notice: Subject to any disclaimer, the term of this patent is extended or adjusted under 35 U.S.C. 154(b) by 395 days.

(21) Appl. No.: 18/406,775

(22) Filed: Jan. 8, 2024

(51) Int. Cl.
*B63H 21/21* (2006.01)

(52) U.S. Cl.
CPC ..... *B63H 21/213* (2013.01)

(58) Field of Classification Search
CPC ..... B63H 21/213
See application file for complete search history.

(56) References Cited

U.S. PATENT DOCUMENTS

| | | | |
|---|---|---|---|
| 1,854,196 | A | 4/1932 | Irgens |
| 2,363,854 | A | 11/1944 | Bierenfeld |
| D188,325 | S | 7/1960 | Brown |
| 3,018,754 | A | 1/1962 | Snyder et al. |
| 3,636,911 | A | 1/1972 | Piazza |
| 3,693,576 | A | 9/1972 | Driscoll |
| 3,865,334 | A | 2/1975 | Wair, Jr. |
| 3,955,527 | A | 5/1976 | Holtermann |
| 3,961,595 | A | 6/1976 | Meyer |
| D246,853 | S | 1/1978 | Berchem |
| 4,071,002 | A | 1/1978 | Frahm |
| 4,295,835 | A | 10/1981 | Mapes et al. |
| 4,318,699 | A | 3/1982 | Wenstadt et al. |
| 4,331,431 | A | 5/1982 | Estes |
| D272,357 | S | 1/1984 | Hall et al. |
| 4,447,214 | A | 5/1984 | Henrich |
| D276,811 | S | 12/1984 | Wolfe |
| 4,496,326 | A | 1/1985 | Boda |

(Continued)

FOREIGN PATENT DOCUMENTS

| | | |
|---|---|---|
| AU | 2019100942 | 9/2019 |
| CA | 2367740 | 7/2002 |

(Continued)

OTHER PUBLICATIONS

Belter, U.S. Appl. No. 18/047,360, filed Oct. 18, 2022, "Configurable Shift and Throttle Mechanism for Tiller of Marine Drive" (specification and drawings only).

(Continued)

*Primary Examiner* — Marc Q Jimenez
*Assistant Examiner* — Jovon E Hayes
(74) *Attorney, Agent, or Firm* — Andrus Intellectual Property Law, LLP

(57) ABSTRACT

A tiller for controlling speed of a marine vessel, the tiller comprising a tiller arm and a grip which is rotatable relative to the tiller arm for controlling at least one operational characteristic of the marine vessel. The grip is rotatable away from a center position in a first direction and in an opposite, second direction. A return device biases the grip back towards the center position in both the first direction and the second direction.

20 Claims, 21 Drawing Sheets

(56) References Cited

U.S. PATENT DOCUMENTS 4,504,778 A 3/1985 Evans
4,521,201 A 6/1985 Watanabe
4,582,493 A 4/1986 Toyohara
4,650,429 A 3/1987 Boda
4,701,141 A 10/1987 Sumigawa
D295,867 S 5/1988 Walsh
4,800,854 A 1/1989 Boda et al.
4,838,820 A 6/1989 Boda et al.
4,878,468 A 11/1989 Boda et al.
4,895,154 A 1/1990 Bartelt
4,897,061 A 1/1990 Koepsel et al.
4,911,665 A 3/1990 Hetzel
5,072,809 A 12/1991 Shibata
D323,508 S 1/1992 Hirshberg et al.
5,145,427 A 9/1992 Kawai et al.
D332,265 S 1/1993 Osumi
5,180,320 A 1/1993 Calamia et al.
D341,365 S 11/1993 Little et al.
D343,625 S 1/1994 Walthall
5,277,634 A 1/1994 Calamia et al.
5,340,342 A 8/1994 Boda et al.
D352,723 S 11/1994 DeBraal et al.
5,378,178 A 1/1995 Haman
D359,290 S 6/1995 Takeuchi
5,509,836 A 4/1996 Ogasawara et al.
5,540,606 A 7/1996 Strayhorn
D373,113 S 8/1996 Stringer
5,632,657 A 5/1997 Henderson
D380,478 S 7/1997 Robbins
D387,775 S 12/1997 Iekura
5,707,262 A 1/1998 Huntley et al.
5,756,949 A 5/1998 Sato
5,797,777 A 8/1998 Tsunekawa et al.
D412,911 S 8/1999 Iekura
5,967,866 A 10/1999 Willows et al.
D416,871 S 11/1999 Todd
D418,519 S 1/2000 Iekura
6,020,563 A 2/2000 Risk, Jr. et al.
D421,444 S 3/2000 Hatch et al.
D428,616 S 7/2000 Iekura
6,093,066 A 7/2000 Isogawa et al.
6,109,986 A 8/2000 Gaynor et al.
6,146,221 A 11/2000 Natsume
D438,493 S 3/2001 Mulliniks et al.
6,264,513 B1 7/2001 Marsh
6,264,516 B1 7/2001 McEathron et al.
D447,123 S 8/2001 Winkler
6,273,771 B1 8/2001 Buckley et al.
D448,037 S 9/2001 Westimayer et al.
6,352,456 B1 3/2002 Jaszewski et al.
D457,166 S 5/2002 Burmeister et al.
6,382,122 B1 5/2002 Gaynor et al.
D458,273 S 6/2002 Burmeister et al.
6,406,342 B1 * 6/2002 Walczak ..... B63H 20/12 440/86
6,406,343 B2 6/2002 Kawai et al.
D460,459 S 7/2002 Hansen
D460,465 S 7/2002 Williams
D460,972 S 7/2002 Osumi
D462,363 S 9/2002 Burmeister et al.
D463,447 S 9/2002 Osumi et al.
D463,448 S 9/2002 Osumi et al.
D463,449 S 9/2002 Osumi
D463,800 S 10/2002 Osumi
D466,907 S 12/2002 Ohsumi
6,494,431 B1 12/2002 McCoy
D470,154 S 2/2003 Burmeister et al.
6,524,148 B2 2/2003 Yoshigasaki et al.
D474,480 S 5/2003 Zebley, Jr. et al.
D474,784 S 5/2003 Sanschagrin et al.
6,558,213 B1 5/2003 McGowan
D478,597 S 8/2003 Zebley, Jr.
6,648,703 B2 11/2003 McChesney et al.
6,663,450 B1 12/2003 Walczak et al.
D485,847 S 1/2004 Sanschagrin et al.
D485,848 S 1/2004 Sanschagrin et al.
D486,500 S 2/2004 Okamoto
D489,380 S 5/2004 Ohsumi et al.
D495,345 S 8/2004 Farlow et al.
D495,716 S 9/2004 Sanschagrin et al.
D497,370 S 10/2004 Katoh
D498,485 S 11/2004 Kuwae
D498,764 S 11/2004 Sanschagrin et al.
D500,056 S 12/2004 DeYoung et al.
6,875,066 B2 4/2005 Wolaver
6,902,450 B2 6/2005 Ohtsuki et al.
6,914,202 B2 7/2005 Sugimoto et al.
7,001,231 B1 2/2006 Halley et al.
D517,096 S 3/2006 Landers et al.
7,090,551 B1 8/2006 Lokken et al.
D527,737 S 9/2006 Lekura
D528,128 S 9/2006 Sanschagrin et al.
D528,563 S 9/2006 Sanschagrin et al.
D531,639 S 11/2006 Okamoto
D531,640 S 11/2006 Okamoto
D536,704 S 2/2007 Iekura
D537,838 S 3/2007 Iekura
7,210,973 B2 5/2007 Sanschagri et al.
7,214,113 B2 5/2007 Kojima
D549,240 S 8/2007 Okamoto
7,267,592 B1 9/2007 Ingebritson et al.
D552,129 S 10/2007 Steinberg
D552,130 S 10/2007 Steinberg et al.
D560,050 S 1/2008 Tokach et al.
7,325,507 B1 * 2/2008 Hundertmark ..... B63H 25/00 440/61 A
D563,907 S 3/2008 Badarello
D565,607 S 4/2008 Moen et al.
7,404,747 B2 7/2008 Shinde et al.
D578,274 S 10/2008 Tokach et al.
7,442,104 B2 10/2008 Okabe
7,455,558 B2 11/2008 Yander
D584,317 S 1/2009 Okamoto
D589,981 S 4/2009 Iekura
7,553,206 B2 6/2009 Hasegawa et al.
7,666,038 B2 2/2010 Yomo et al.
D611,062 S 3/2010 Okamoto
D611,063 S 3/2010 Okamoto
D611,501 S 3/2010 Vignau et al.
D611,502 S 3/2010 Vignau et al.
7,677,938 B2 3/2010 Wiatrowski et al.
7,681,513 B1 * 3/2010 Hundertmark ..... F15B 13/0422 114/144 R
7,704,110 B2 4/2010 Wiatrowski et al.
7,736,207 B2 6/2010 Vignau
D623,661 S 9/2010 Yamagishi et al.
D624,567 S 9/2010 Kelley
D626,975 S 11/2010 Ryczek et al.
D629,818 S 12/2010 Rummer et al.
D635,154 S 3/2011 Rummer et al.
7,895,959 B1 3/2011 Angel et al.
D635,586 S 4/2011 Okamoto
7,976,354 B2 7/2011 Kubota et al.
D643,440 S 8/2011 Dannenberg et al.
8,106,617 B1 1/2012 Holley
D655,308 S 3/2012 Steinberg
D655,320 S 3/2012 Hiraoka et al.
D657,400 S 4/2012 Loew
D660,323 S 5/2012 Hiraoka et al.
D660,614 S 5/2012 Palmeiri
D663,321 S 7/2012 Okamoto
8,257,122 B1 9/2012 Holley
8,651,906 B1 2/2014 Morton
D706,313 S 6/2014 Higashikawa et al.
D707,729 S 6/2014 Jackson et al.
D708,233 S 7/2014 Furuki et al.
D709,918 S 7/2014 Jones, Sr.
D712,931 S 9/2014 Matsumoto
D714,345 S 9/2014 Petit et al.
D715,333 S 10/2014 Jacobsthal et al.
D716,846 S 11/2014 Carter et al.
8,930,050 B2 1/2015 Garon et al.
D727,969 S 4/2015 Okamoto
9,004,964 B2 4/2015 Grez

(56) References Cited

U.S. PATENT DOCUMENTS

| | | | | |
|---|---|---|---|---|
| D728,640 | S | 5/2015 | Turner et al. | |
| 9,039,469 | B1 | 5/2015 | Calamia et al. | |
| 9,073,616 | B1 | 7/2015 | Wiegele et al. | |
| 9,109,616 | B1 | 8/2015 | Ballentine | |
| D740,858 | S | 10/2015 | Dannenberg et al. | |
| 9,180,950 | B1 | 11/2015 | Davenport et al. | |
| 9,205,906 | B1 | 12/2015 | Eichinger | |
| 9,216,805 | B1 | 12/2015 | Amerling et al. | |
| D757,126 | S | 5/2016 | Vaninetti et al. | |
| 9,359,059 | B1 | 6/2016 | Scherer, III et al. | |
| 9,359,981 | B1 | 6/2016 | Waisanen et al. | |
| 9,376,194 | B1 | 6/2016 | Jensen et al. | |
| 9,422,045 | B2 | 8/2016 | Kinpara et al. | |
| 9,481,438 | B1 | 11/2016 | Tuchscherer | |
| 9,580,947 | B1 | 2/2017 | Amerling et al. | |
| 9,587,601 | B1 | 3/2017 | Ochiai | |
| D791,189 | S | 7/2017 | Scherer, III et al. | |
| 9,694,892 | B1 | 7/2017 | Anschuetz et al. | |
| 9,701,383 | B1 | 7/2017 | Stuber et al. | |
| D794,078 | S | 8/2017 | Vaninetti | |
| D794,079 | S | 8/2017 | Vaninetti et al. | |
| 9,764,813 | B1 | 9/2017 | Zarembka et al. | |
| 9,783,278 | B1 | 10/2017 | Dannenberg et al. | |
| 9,789,945 | B1 | 10/2017 | Vaninetti et al. | |
| 9,840,316 | B1 | 12/2017 | Jaszewski | |
| D806,752 | S | 1/2018 | Vaninetti et al. | |
| D807,920 | S | 1/2018 | Vaninetti | |
| D809,017 | S | 1/2018 | Noda et al. | |
| 9,868,501 | B1 | 1/2018 | Gable et al. | |
| 9,926,064 | B1 | 3/2018 | Tuchscherer | |
| D816,716 | S | 5/2018 | Abellera et al. | |
| D832,472 | S | 10/2018 | Davis et al. | |
| D834,617 | S | 11/2018 | Zin et al. | |
| D834,618 | S | 11/2018 | Zin et al. | |
| D835,675 | S | 12/2018 | Nakaura et al. | |
| 10,155,578 | B1 | 12/2018 | Osthelder et al. | |
| D842,504 | S | 3/2019 | Davis et al. | |
| 10,246,173 | B1 * | 4/2019 | Ingebritson | B63H 21/213 |
| D852,230 | S | 6/2019 | Zin et al. | |
| D852,848 | S | 7/2019 | Zin et al. | |
| D852,849 | S | 7/2019 | Zin et al. | |
| D852,850 | S | 7/2019 | Zin et al. | |
| 10,343,759 | B2 | 7/2019 | Despineux | |
| D859,469 | S | 9/2019 | Zin et al. | |
| 10,507,898 | B1 | 12/2019 | Belter et al. | |
| 10,578,042 | B2 | 3/2020 | Buis | |
| D886,865 | S | 6/2020 | Bailey | |
| 10,696,367 | B1 | 6/2020 | Ingebritson et al. | |
| 10,723,429 | B1 | 7/2020 | Wiatrowski et al. | |
| 10,787,236 | B1 * | 9/2020 | Erickson | B63H 20/12 |
| D911,296 | S | 2/2021 | Li | |
| 10,940,917 | B2 | 3/2021 | Montague et al. | |
| D917,565 | S | 4/2021 | Vaninetti et al. | |
| 10,981,639 | B2 | 4/2021 | Kimpara et al. | |
| 11,084,563 | B1 | 8/2021 | Pielow et al. | |
| 11,097,824 | B1 | 8/2021 | Anderson, Jr. | |
| 11,097,826 | B1 | 8/2021 | Dannenberg et al. | |
| 11,186,352 | B1 * | 11/2021 | Erickson | B63H 21/213 |
| 11,352,118 | B1 | 6/2022 | Dengel et al. | |
| 11,628,919 | B1 | 4/2023 | Pielow et al. | |
| 12,528,571 | B1 * | 1/2026 | Needham | B63H 20/12 |
| 2002/0142680 | A1 | 10/2002 | Anderson | |
| 2003/0024456 | A1 | 2/2003 | Swetish | |
| 2003/0176121 | A1 | 9/2003 | Kitsu | |
| 2003/0194927 | A1 | 10/2003 | Sanschagrin et al. | |
| 2003/0232548 | A1 | 12/2003 | Alby et al. | |
| 2004/0107789 | A1 | 6/2004 | Peppard | |
| 2004/0121667 | A1 | 6/2004 | Okabe | |
| 2004/0137806 | A1 | 7/2004 | Ohtsuki et al. | |
| 2005/0262958 | A1 | 12/2005 | Kojima | |
| 2006/0172631 | A1 | 8/2006 | Kameoka | |
| 2007/0042652 | A1 | 2/2007 | Kitsu et al. | |
| 2007/0197109 | A1 | 8/2007 | Yander | |
| 2008/0038967 | A1 | 2/2008 | Shinde | |
| 2008/0268729 | A1 | 10/2008 | Yomo et al. | |
| 2009/0075534 | A1 | 3/2009 | Wiatrowski et al. | |
| 2010/0147257 | A1 | 6/2010 | Yazaki et al. | |
| 2011/0104963 | A1 | 5/2011 | Ellis | |
| 2013/0280970 | A1 | 10/2013 | Clarkson et al. | |
| 2014/0057508 | A1 | 2/2014 | Litjens et al. | |
| 2014/0306505 | A1 | 10/2014 | Koch | |
| 2016/0023740 | A1 | 1/2016 | Skrzypchak et al. | |
| 2017/0043787 | A1 | 2/2017 | Mangette et al. | |
| 2017/0306830 | A1 | 10/2017 | Bruestle et al. | |
| 2019/0176952 | A1 | 6/2019 | Clark et al. | |
| 2020/0156751 | A1 | 5/2020 | Skrzypchak et al. | |
| 2020/0172220 | A1 * | 6/2020 | Chung | B63H 5/125 |
| 2021/0061431 | A1 | 3/2021 | Mcginley | |
| 2023/0102741 | A1 | 3/2023 | Fergus | |
| 2023/0257091 | A1 | 8/2023 | Ahlswede et al. | |
| 2023/0257092 | A1 | 8/2023 | Ahlswede et al. | |
| 2023/0257093 | A1 | 8/2023 | Ahlswede et al. | |
| 2023/0257094 | A1 | 8/2023 | Jaszewski et al. | |

FOREIGN PATENT DOCUMENTS

| | | | | |
|---|---|---|---|---|
| EP | 1101696 | | 5/2001 | |
| EP | 1400720 | | 3/2004 | |
| EP | 3326903 | | 4/2019 | |
| JP | S60 38293 | | 2/1985 | |
| JP | 3946315 | | 7/2007 | |
| JP | 4094151 | | 6/2008 | |
| JP | 2011-213215 | | 10/2011 | |
| JP | 2013-173423 | | 9/2013 | |
| JP | 5741259 | | 7/2015 | |
| JP | 5927980 | | 6/2016 | |
| WO | WO 2004-035381 | | 4/2004 | |
| WO | WO-2023114098 | A1 * | 6/2023 | B63H 20/12 |
| WO | WO-2023114101 | A1 * | 6/2023 | B63H 20/12 |

OTHER PUBLICATIONS

Mercury Marine, 15/20hp EFI Fourstroke Outboard Tiller, tiller handle, available at least as early as Nov. 17, 2017.

Mercury Marine, Big Tiller for 75-300 HP Mercury Outboards, tiller handle, available at least as early as 2018, admitted prior art.

Vaninetti et al, "Tiller for Outboard Motor," Unpublished U.S. Appl. No. 29/610,556, filed Jul. 13, 2017.

Fergus, et al., Unpublished U.S. Appl. No. 17/487,116.

Jaszewski, et al., Unpublished U.S. Appl. No. 17/585,214.

* cited by examiner

TILLERS FOR CONTROLLING AN OPERATIONAL CHARACTERISTIC OF MARINE DRIVES

FIELD

The present disclosure relates to tillers for controlling an operational characteristic of marine drives.

BACKGROUND

U.S. Pat. Pub. No. 2023/0257092 is incorporated herein by reference and discloses a tiller for controlling a marine drive. The tiller has a base bracket assembly and a tiller arm which extends outwardly from the base bracket assembly. The base bracket assembly is configured to facilitate yaw adjustment of the tiller arm into and between a variety of yaw positions relative to the base bracket assembly. The tiller arm has a grip restraining device which is located on the bottom of the middle portion of the tiller arm and is manually accessible from both sides of the tiller arm. The grip restraining device is specially configured to selectively restrain rotation of a hand grip on the outer end of the tiller arm. The tiller arm also has a tilt mechanism which facilitates tilting of the tiller arm relative to the base bracket assembly into and between a variety of tilt positions.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In independent examples, a tiller is for controlling speed of a marine vessel. The tiller comprises a tiller arm and a grip which is rotatable relative to the tiller arm for controlling at least one operational characteristic of the marine vessel. The grip is rotatable away from a center position in a first direction and in an opposite, second direction. The tiller further comprises a return device which biases the grip back towards the center position in both the first direction and the second direction.

In independent examples, the return device comprises a first spring configured to bias the grip opposite the first direction, and a second spring configured to bias the grip opposite the second direction.

In independent examples, the first spring and the second spring are separate components.

In independent examples, the return device comprises a first spring configured to apply a first spring bias on the grip as the grip is rotated from the center position in the first direction but to not apply the first spring bias on the grip as the grip is rotated from the center position in the second direction. The return device further comprises a second spring configured to apply a second spring bias on the grip as the grip is rotated from the center position in the second direction but to not apply the second spring bias on the grip as the grip is rotated from the center position in the first direction.

In independent examples, the return device comprises a first spring configured to rotate the grip towards the center position opposite the first direction and a second spring configured to rotate the grip towards the center position opposite the second direction.

In independent examples, the first spring and the second spring have ends coupled to the grip and to the tiller arm, respectively.

In independent examples, rotating the grip away from the center position in the first direction winds the first spring but not the second spring, and rotating the grip away from the center position in the second direction winds the second spring but not the first spring.

In independent examples, the first spring comprises a first end coupled to the grip and a second end coupled to the tiller arm. The second spring comprises a first end coupled to the grip and a second end coupled to the tiller arm.

In independent examples, the return device comprises a first spring coupled to one of the grip and the tiller arm via a slot which engages the first spring when the grip is rotated away from the center position in the first direction but which disengages from the first spring when the grip is rotated away from the center position in the second direction. The return device includes a second spring coupled to one of the grip and the tiller arm via a slot which engages the second spring when the grip is rotated away from the center position in the second direction but which disengages from the second spring when the grip is rotated away from the center position in the first direction.

In independent examples, the grip is coupled to an elongated member extending in the tiller arm such that rotation of the grip causes rotation of the elongated member. The first spring and the second spring are coupled to the elongated member and to the tiller arm.

In independent examples, the first spring is coupled to one of the elongated member and the tiller arm via a slot which engages the first spring when the grip is rotated away from the center position in the first direction, but which disengages from the first spring when the grip is rotated away from the center position in the second direction. The second spring is coupled to one of the elongated member and the tiller arm via a slot which engages the second spring when the grip is rotated away from the center position in the second direction.

In independent examples, the return device is configured to increase a first spring bias on the grip as the grip is rotated in the first direction. The return device is further configured to increase a second spring bias on the grip as the grip is rotated in the second direction. The first spring bias and the second spring bias are proportionally equal.

In independent examples, a tiller is for controlling speed of a marine vessel. The tiller comprises a tiller arm and a manually-operable member which is movable relative to the tiller arm for controlling at least one operational characteristic of the marine vessel. The manually-operable member is movable away from a center position in a first direction and in an opposite, second direction. The tiller further comprises a return device which biases the manually-operable member back towards the center position in both the first direction and the second direction.

In independent examples, the manually-operable member comprises a grip.

In independent examples, the return device comprises a first spring configured to bias the grip opposite the first direction, and a second spring configured to rotate the grip opposite the second direction.

In independent examples, the return device comprises a first spring configured to bias the grip opposite the first direction, and a second spring configured to rotate the grip opposite the second direction.

In independent examples, the return device comprises a first spring configured to rotate the manually-operable member towards the center position opposite the first direction, and a second spring configured to rotate the manually-operable member towards the center position opposite the second direction.

In independent examples, rotating the manually-operable member away from the center position in the first direction winds the first spring but not the second spring, and rotating the manually-operable member away from the center position in the second direction winds the second spring but not the first spring.

In independent examples, the first spring is coupled to one of the manually-operable member and the tiller arm via a slot which engages the first spring when the manually-operable member is rotated away from the center position in the first direction but which disengages from the first spring when the manually-operable member is rotated away from the center position in the second direction. Further, the second spring is coupled to one of the manually-operable member and the tiller arm via a slot which engages the second spring when the manually-operable member is rotated away from the center position in the second direction but which disengages from the second spring when the manually-operable member is rotated away from the center position in the first direction.

In independent examples, the return device is configured to increase a first spring bias on the manually-operable member as the manually-operable member is rotated in the first direction, and the return device is configured to increase a second spring bias on the manually-operable member as the manually-operable member is rotated in the second direction. The first spring bias and the second spring bias are proportionally equal.

In independent examples, the return device comprises a dual counter-acting spring device.

BRIEF DESCRIPTION OF THE DRAWINGS

Embodiments are described with reference to the following drawing figures. The same numbers are used throughout to reference like features and components.

DETAILED DESCRIPTION

Figure 1:
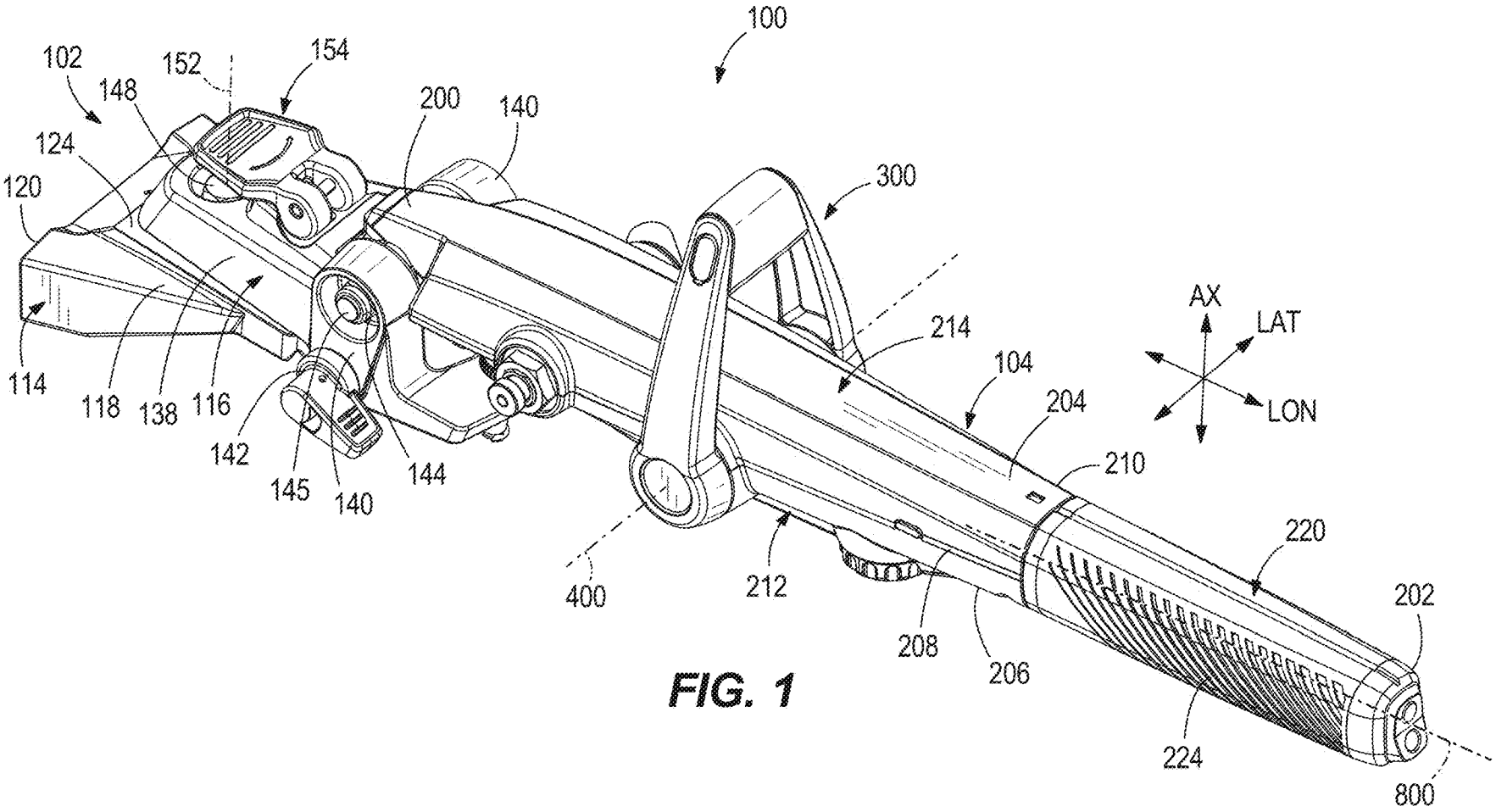
FIG. 1 is a perspective view looking down at a tiller according to the present disclosure.

FIG. 1 illustrates a tiller 100 for controlling a not-shown marine drive, such as but not limited to an outboard motor, trolling motor, or any other type of marine drive. In general, the tiller 100 has a base bracket assembly 102 and a tiller arm 104 which is coupled to and extends from the base bracket assembly 102. As further described herein below, the tiller arm 104 is specially configured for ambidextrous use.

Referring to FIG. 1, the base bracket assembly 102 includes a yaw bracket 114 which is pivotably coupled to a steering bracket 116 of the tiller arm 104. The yaw bracket 114 is a rigid member having a body 118 providing a base 120 configured for fixed mounting to the not-shown steering arm of the marine drive. The body 118 has an upper face providing a pedestal 124 upon which the steering bracket 116 is mounted. A through-bore (not shown) extends through a center portion of the pedestal 124, defining a yaw axis 152 about which the tiller arm 104 is pivotable.

The steering bracket 116 is a rigid member having a body 138 and a pair of upwardly angled arms 140 having opposed lower through-bores 142 through the lower ends of the arms 140 and opposed through-bores 144 through the upper ends of the arms 140. A fastener 145 extends through the opposed through-bores 144 and through a corresponding through-bore (not shown) in the tiller arm 104 to couple the tiller arm 104 to the steering bracket 116 in a way that the tiller arm 104 is tiltable up and down relative to the steering bracket 116. The fastener 145 defines a tilt axis about which the tiller arm 104 is pivotable relative to the base bracket assembly 102. Further description of one example of a suitable tilt mechanism such as what is shown in the drawings is presented in U.S. Patent Application No. 2023/0257092, which is incorporated by reference herein.

A fastener 148 extends through the body 138 and through the through-bore 126 of the yaw bracket 114 along the yaw axis 152. As explained above, the yaw bracket 114 is fixed to the steering arm of the marine drive and the steering bracket 116 is attached to the tiller arm 104. Thus, the tiller arm 104 and steering bracket 116 are pivotable together about the yaw axis 152 into and between a variety of yaw positions relative to the yaw bracket 114 and marine drive, as will be further described herein below. A yaw lock 154 is specially configured to lock the tiller arm 104 and steering bracket 116 in a variety of yaw positions relative to the yaw bracket 114 and marine drive. A shift lever 300 is positioned along a middle portion of the chassis 212 and pivotably coupled to the tiller arm 104 along a lateral pivot axis 400 for changing an operational characteristic of the marine drive. Further descriptions of examples of suitable yaw mechanisms and shift levers like what are shown in the drawings are presented in U.S. Patent Application No.

2023/0257092, which is incorporated by reference herein. Referring to FIG. 1, the tiller arm 104 extends from an inner end 200 to an outer end 202 in a longitudinal direction LO, from top 204 to bottom 206 in an axial direction AX which is perpendicular to the longitudinal direction LO, and from a port side 208 to a starboard side 210 which is opposite the port side 208 in a lateral direction LA which is perpendicular to the longitudinal direction LO and perpendicular to the axial direction AX.

Figure 2:
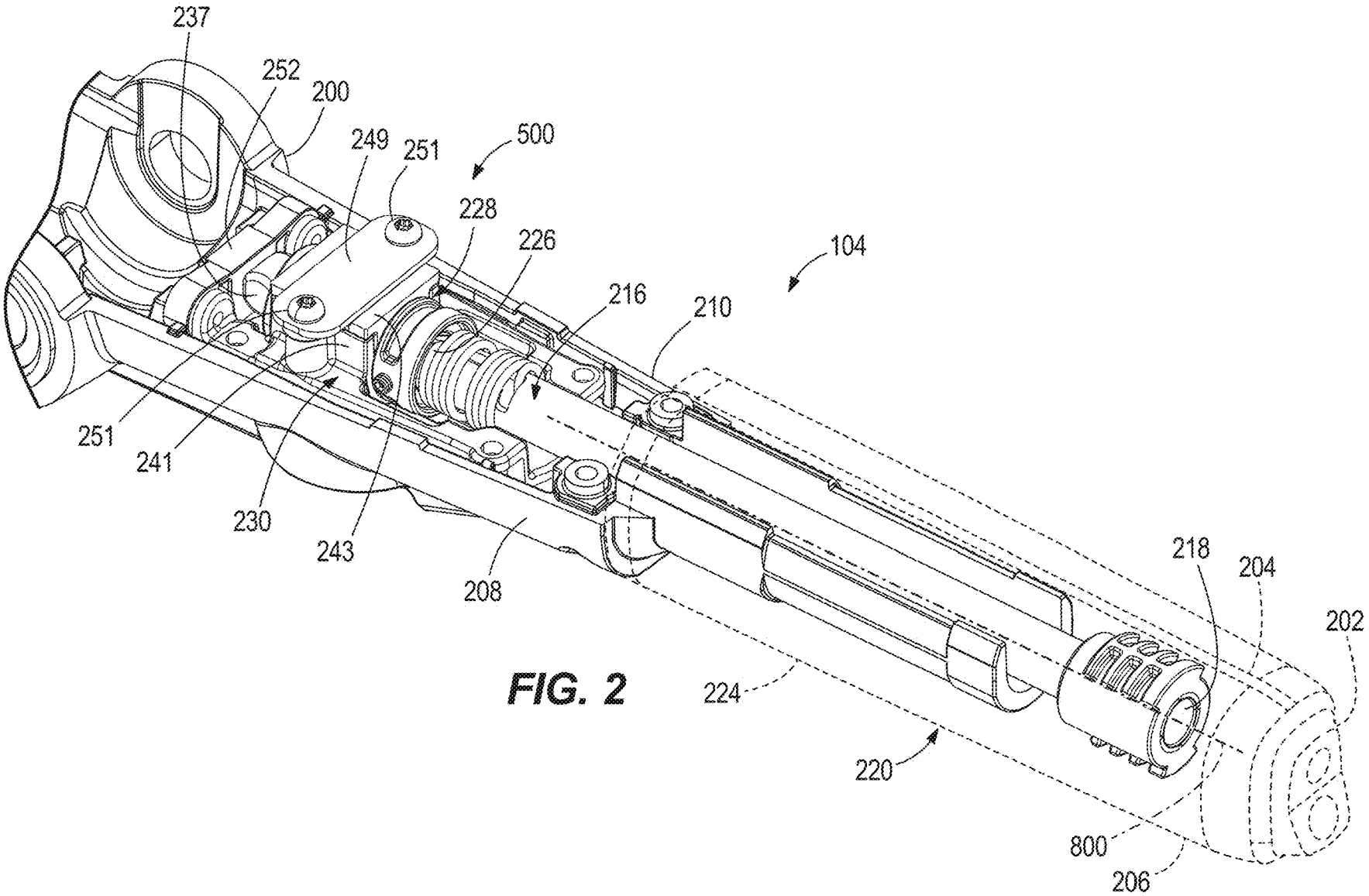
FIG. 2 is a perspective view of a chassis of the tiller arm, partially in phantom, illustrating a return device according to a first embodiment.

Referring to FIGS. 1-2, tiller arm 104 has a chassis 212 which is elongated in the longitudinal direction LO and underlies and supports various components associated with the tiller arm 104. A cover 214 (FIG. 1) is mounted on top of chassis 212 and encloses the various components in an interior of the tiller arm 104. Referring to FIG. 2, a shaft 216 protrudes from the interior via a passage defined between the front of the chassis 212 and cover 214. The shaft 216 is rotatable about a grip axis 800 and has a front end 218 which is coupled to a manually operable member, which in the illustrated embodiment is a grip 220. The front end 218 is engaged with a grooved grip cover 224 of the grip 220. The shaft 216 is coupled to the grip 220 such that manually rotating the grip 220 relative to the chassis 212 and cover 214 causes rotation of the shaft 216 relative to the chassis 212 and cover 214.

The shaft 216 has a rear end 226 which has a shaft extension 228 located within a supporting tray 230. A magnetic sensor 252 (FIG. 2) is mounted to the chassis 212 and is configured to sense rotation of the shaft 216 (via the shaft extension 228) and communicate such sensed rotation to a controller for the associated marine drive. Sensing arrangements for sensing rotation of a shaft in a tiller arm are conventional and well known in this art and thus not further herein described. The grip 220 and shaft 216, including the shaft extension 228, are rotatable in opposite directions away from the center position shown and thus are configured for ambidextrous use, as will be discussed further herein. That is, the grip 220 can be rotated in the first direction 234 (FIG. 6) to increase the speed of the marine drive and alternately the grip 220 can be rotated in the second direction 236 (FIG. 7) to increase the speed of the marine drive.

Figure 4:
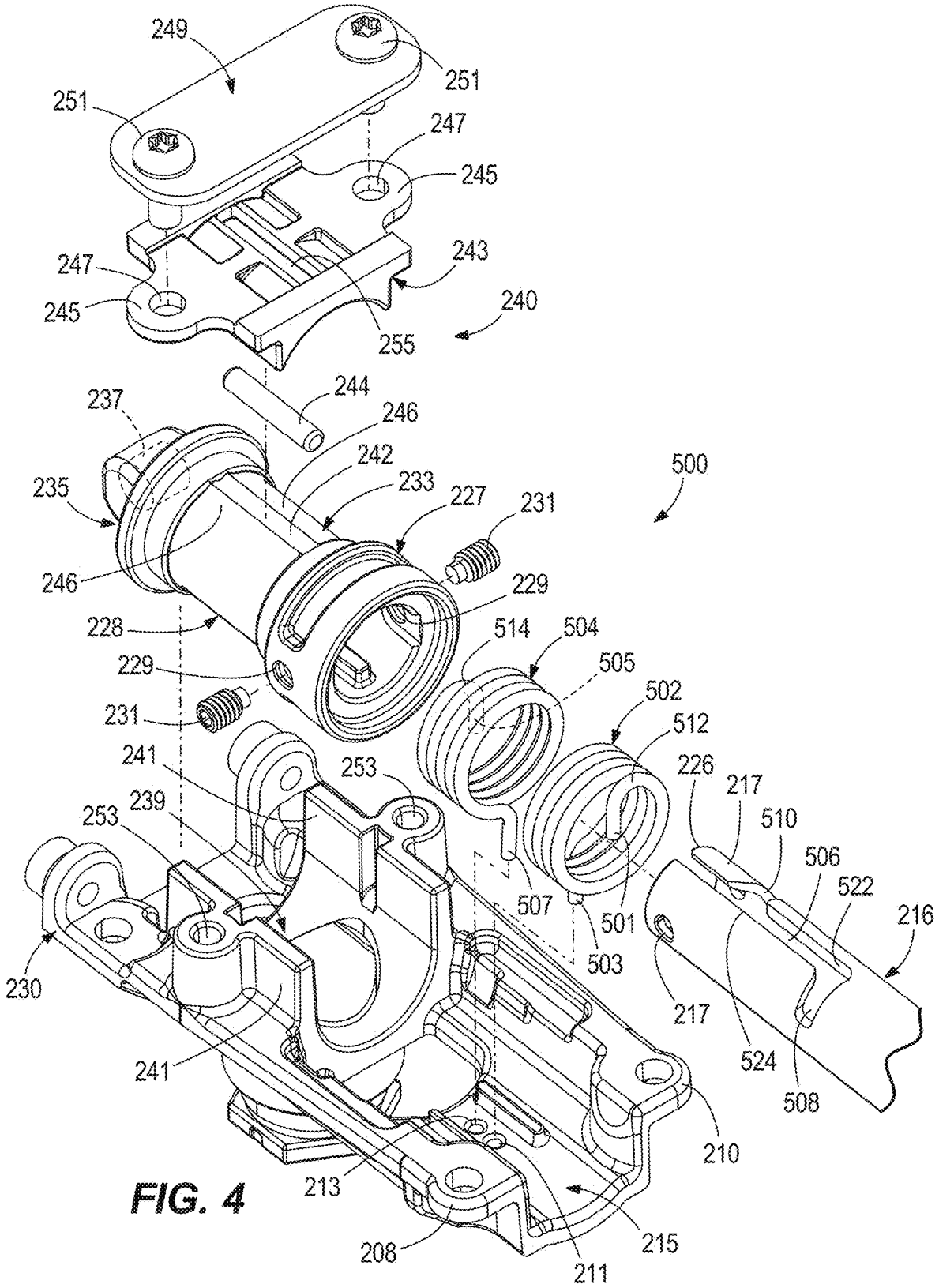
FIG. 4 is an exploded view of the return device of FIG. 2.

Referring now to FIG. 4, the shaft extension 228 and the supporting tray 230 further has a detent mechanism 240 which provides tactile feedback to the user grasping the grip 220 when the grip 220 is rotated into the center position shown, which corresponds to a neutral position for the marine drive. A return device 500 of the present disclosure is positioned within the supporting tray 230 to bias the grip 220 toward the center position from either rotation direction, as will be described further herein.

Best shown in FIG. 4, the shaft 216 has bores 217 extending through the rear end 226 for fixed engagement with the shaft extension 228. The shaft extension 228 has a cylindrical body 227 within which the rear end 226 extends and is coupled. The cylindrical body 227 has threaded bores 229 which align with the bores 217 of the shaft 216. Set screws 231 extend through the threaded bores 229 and then through the bores 217 to fixedly couple the shaft extension 228 to the shaft 216. The shaft extension 228 has a neck 233 that extends between the body 227 and a head 235. The neck 233 and the supporting tray 230 together form the detent mechanism 240 as described further herein below. The head 235 forms an end cap on the shaft extension 228 and is configured to support a magnet 237 (FIG. 4) which is rotated via the hand grip 222 to communicate a change in speed of the marine drive to the controller.

Figure 3:
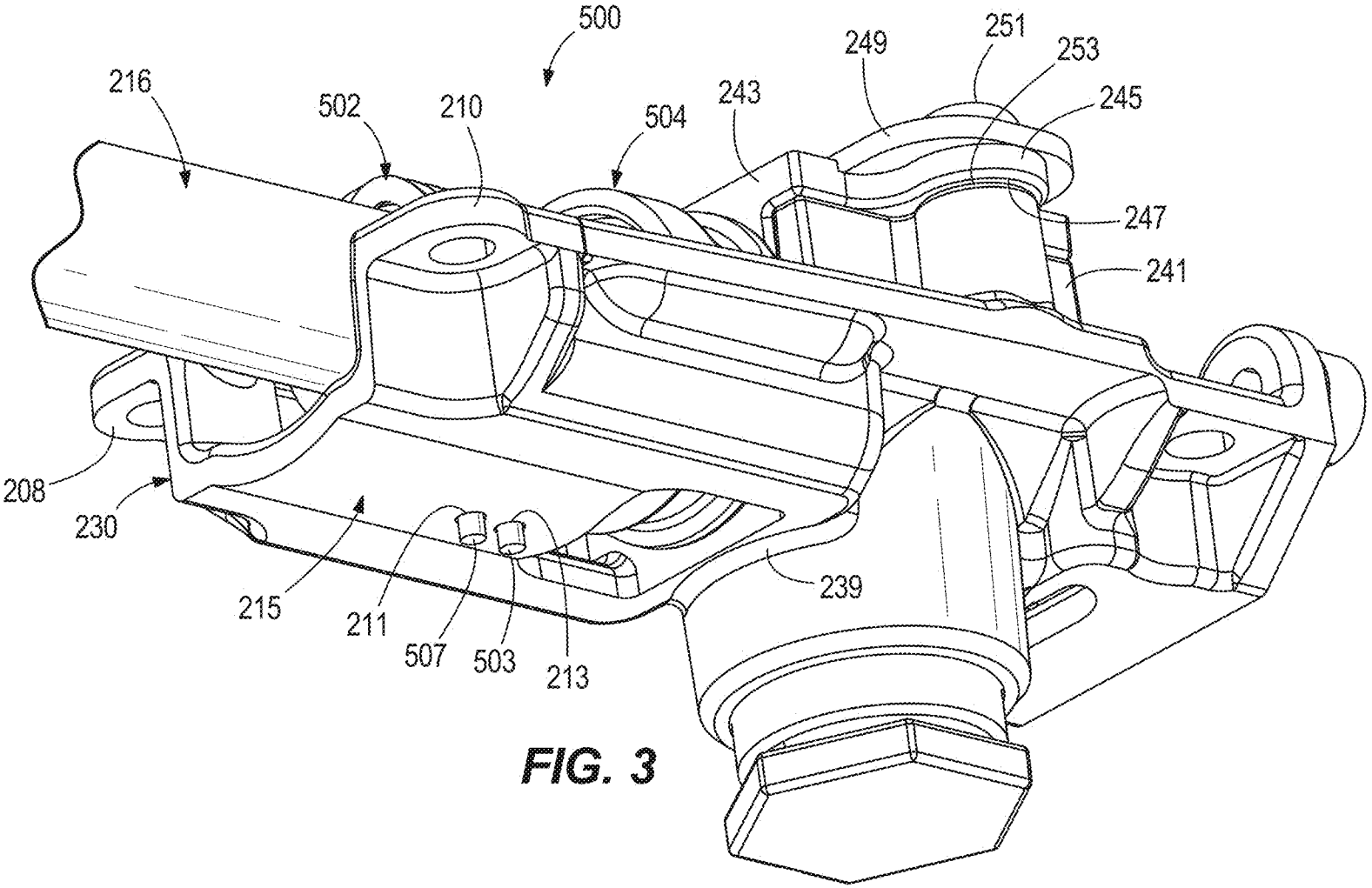
FIG. 3 is a perspective view of an underside of the return device of FIG. 2.

Referring to FIGS. 3-4, the supporting tray 230 has a U-shaped cradle 239 (FIG. 4) within which the shaft extension 228 rotates. The cradle 239 has laterally opposed side walls 241 and an arched cover piece 243 defining a receiving space for the shaft extension 228. The cover piece 243 has lugs 245 with through-bores 247 which align with laterally opposed bores 253 on either side of the cradle 239. A top plate 249 is positioned on top of the cover piece 243 and secures the cover piece 243 to the side walls 241 via fasteners 251. In certain embodiments, the top plate 249 is made of plastic material which is resilient and permits movement of the detent mechanism 240, as explained below. The fasteners 251 extend through bores (not shown) in the top plate 249, the through-bores 247 of the lugs 245, and the bores 253 on the side walls 241. A groove 255 extends longitudinally on an underside of the cover piece 243 is configured to engage with the detent mechanism 240.

The detent mechanism 240 includes a raised groove 242 on the top of the outer diameter of the shaft extension 228 and a roller pin 244. The roller pin 244 is positioned within the groove 255 of the cover piece 243 and engages with the neck 233 of the shaft extension 228. The roller pin 244 becomes aligned with and pops into the raised groove 242 when the grip 220 and the shaft extension 228 are rotated into the center position. As mentioned above, the resilient top plate 249 acts as a spring to allow the roller pin 244 to move up and down. Seating of the roller pin 244 provides tactile feedback in the form of a click which can be felt by the user grasping the grip 220. Smoothly contoured surfaces 246 provide ramps on opposite sides of the raised groove 242 leading up to the groove 242 and thus provide a gradually increasing resistance to the user rotating the grip 220 towards the center position until the roller pin 244 becomes aligned with and seats in the raised groove 242.

Figure 5:
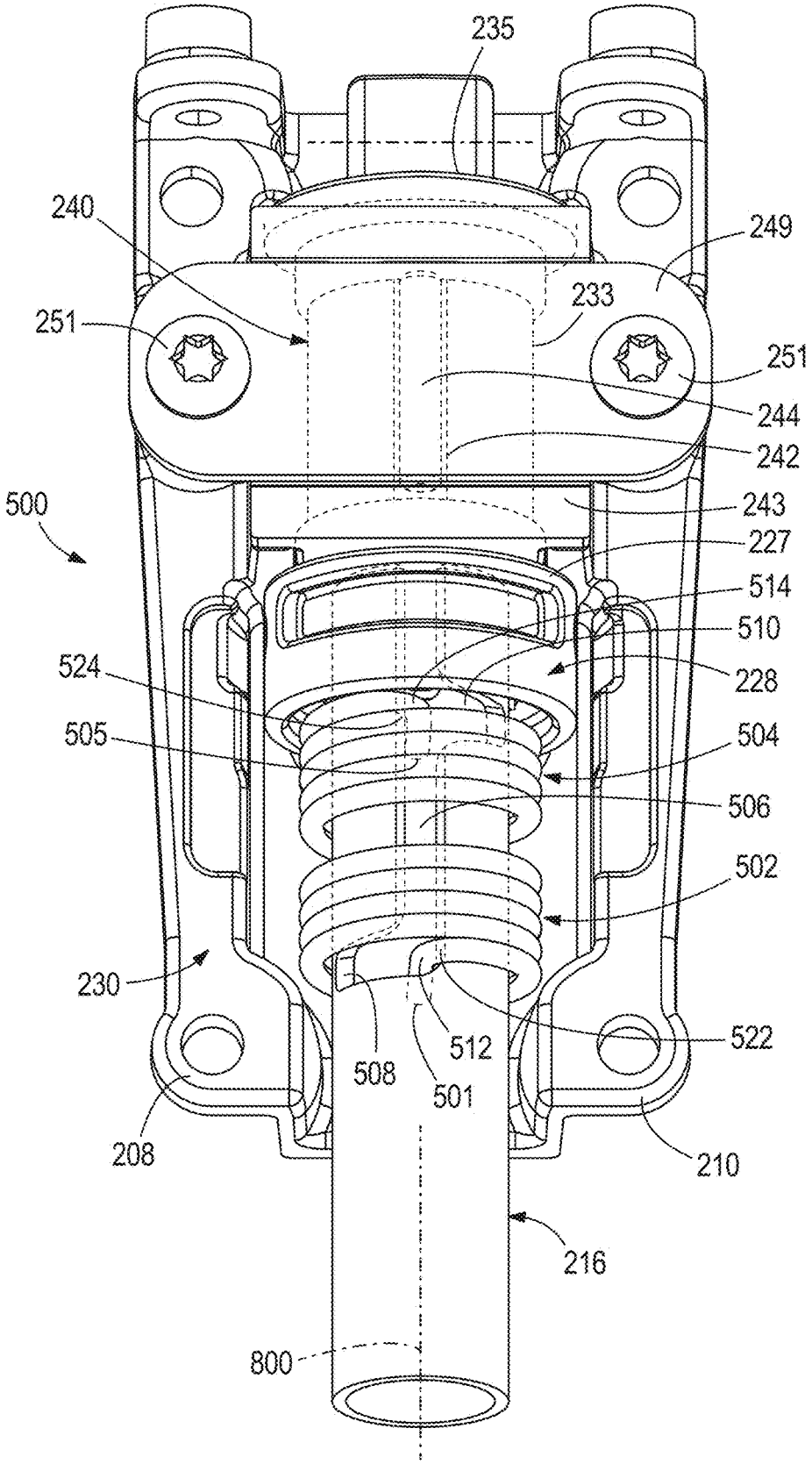
FIGS. 5-7 are overhead views of the return device of FIG. 2, partially in phantom.

Referring to FIGS. 2 and 4-5, in a first embodiment, a return device 500 has a first coiled torsion spring 502 and a second coiled torsion spring 504 which are disposed on the shaft 216. The return device 500 rotationally biases the shaft 216 towards the center position shown in FIG. 5, however the spring bias provided by the first and the second torsion springs 502, 504 is not great enough to overcome the engagement force between the roller pin 244 and the ramped surfaces 246. Instead, it is necessary to apply manual rotational force on the shaft 216 via the grip 220 to bring the raised groove 242 into alignment with the roller pin 244. Manually releasing the grip 220 permits the return device 500 to rotate the shaft 216 and grip 220 back towards the center position until the respective ramped surface 246 engages the roller pin 244. To fully move the grip 220 back to the center position, the user must grasp and rotate the grip 220 with a force needed to push the ramped surface 246 past the roller pin 244 so that the roller pin 244 will pop into place in the raised groove 242.

Current tiller designs include tiller arms with return devices configured for rotation of the hand grip in one direction of rotation. To change the direction of rotation that corresponds to forward propulsion of the marine drive, a user is required to mechanically alter the tiller arm, sometimes requiring the user to disassemble and reconfigure the tiller arm. During research and development in this field, the present inventors determined it would be advantageous to improve upon existing tiller designs by incorporating an ambidextrous return device having a dual counter-acting spring device which biases the hand grip and shaft toward the center position when rotated in either a first direction or a second opposite direction. The present disclosure is a result of the present inventor's realization of the above-described areas for improvement on known configurations and particularly their resulting efforts to provide ambidextrous return devices in accordance with the above.

Referring to FIGS. 2-4, an ambidextrous return device 500 of the present disclosure is positioned at a middle portion of the chassis 212 within the supporting tray 230 and engaged with the shaft 216 and the shaft extension 228 for changing an operational characteristic of the marine drive. In the illustrated embodiment, the operational characteristic is the speed of the marine drive, however other operational characteristics are possible such as but not limited to gear position of the marine drive. As described previously, the grip 220 can be rotated in the first direction 234 (FIG. 6) to increase the speed of the marine drive and alternately the grip 220 can be rotated in the second direction 236 (FIG. 7) to increase the speed of the marine drive.

Referring primarily to FIG. 4, a first embodiment of the return device 500 includes a first torsion spring 502 and a second torsion spring 504 having a first spring bias and a second spring bias, respectively. In a preferred embodiment, the first and the second spring biases are proportionally equal, although such a configuration is not limiting. The first and the second torsion springs 502, 504 are coupled to the supporting tray 230 and coupled to the grip 220 via the shaft 216. The first and the second torsion spring 502, 504 extend around the rear end 226 of the shaft 216 and are seated within and engage with a base plate 215 of the supporting tray 230, as shown in FIG. 3. The rear end 226 of the shaft 216 has an engagement slot 506 extending longitudinally from the rear end 226 toward the front end 218. The engagement slot 506 has a first retaining slot 508 and a second retaining slot 510 for receiving the first and the second torsion springs 502, 504, respectively, when the grip 220 is rotated. The first and the second retaining slot 508, 510 are longitudinally offset from one another and extend laterally outward from the engagement slot 506 in opposite directions, as shown in FIG. 4. The first retaining slot 508 extends from the engagement slot 506 such that an inner end constitutes a first slot stop 522 for engagement with the first torsion spring 502. The second retaining slot 510 extends from the engagement slot 506 such that an inner end constitutes a second slot stop 524 for engagement with the second torsion spring 504, as will be described further herein. The first slot stop 522 and the second slot stop 524 are positioned on laterally opposed ends of the engagement slot 506 such that rotation of the grip 220 in either the first or the second direction 234, 236 engages only one of the first or the second slot stops 522, 524.

Referring to FIGS. 4-5, the first torsion spring 502 has a first end 501 which is bent downwardly within the engagement slot 506 and forms a hook 512 which is rotatable into and out of engagement with the first slot stop 522. The first end 501 is positioned in alignment with the first retaining slot 508. The first torsion spring 502 further has a second end 503 which extends downwardly into a first hole 211 within the base plate 215 of the supporting tray 230. The first torsion spring 502 is wound such that the first end 501 is positioned forwardly of the second end 503 with respect to the grip 220. The second torsion spring 504 is positioned rearwardly of the first torsion spring 502. The second torsion spring 504 has a first end 505 which is bent downwardly within the engagement slot 506 and forms a hook 514 which is rotatable into and out of engagement with the second slot stop 524. The first end 505 is positioned in alignment with the second retaining slot 510. The second torsion spring 504 further has a second end 507 which extends into a second hole 213 within the base plate 215 adjacent the first hole 211. The second torsion spring 504 is wound such that the first end 505 is positioned rearwardly of the second end 507 with respect to the grip 220. The first torsion spring 502 and the second torsion spring 504 are wound in the same direction but are oriented oppositely with respect to the shaft 216 such that each of the first and the second torsion springs 502, 504 bias the grip 220 toward the center from each direction 234, 236. Such a configuration allows for ease of manufacturing by eliminating the need for oppositely wound pairs of torsion springs. However this is not a limiting example, as described further herein below, the first and the second torsion springs 502, 504 may be oppositely wound.

Figure 6:
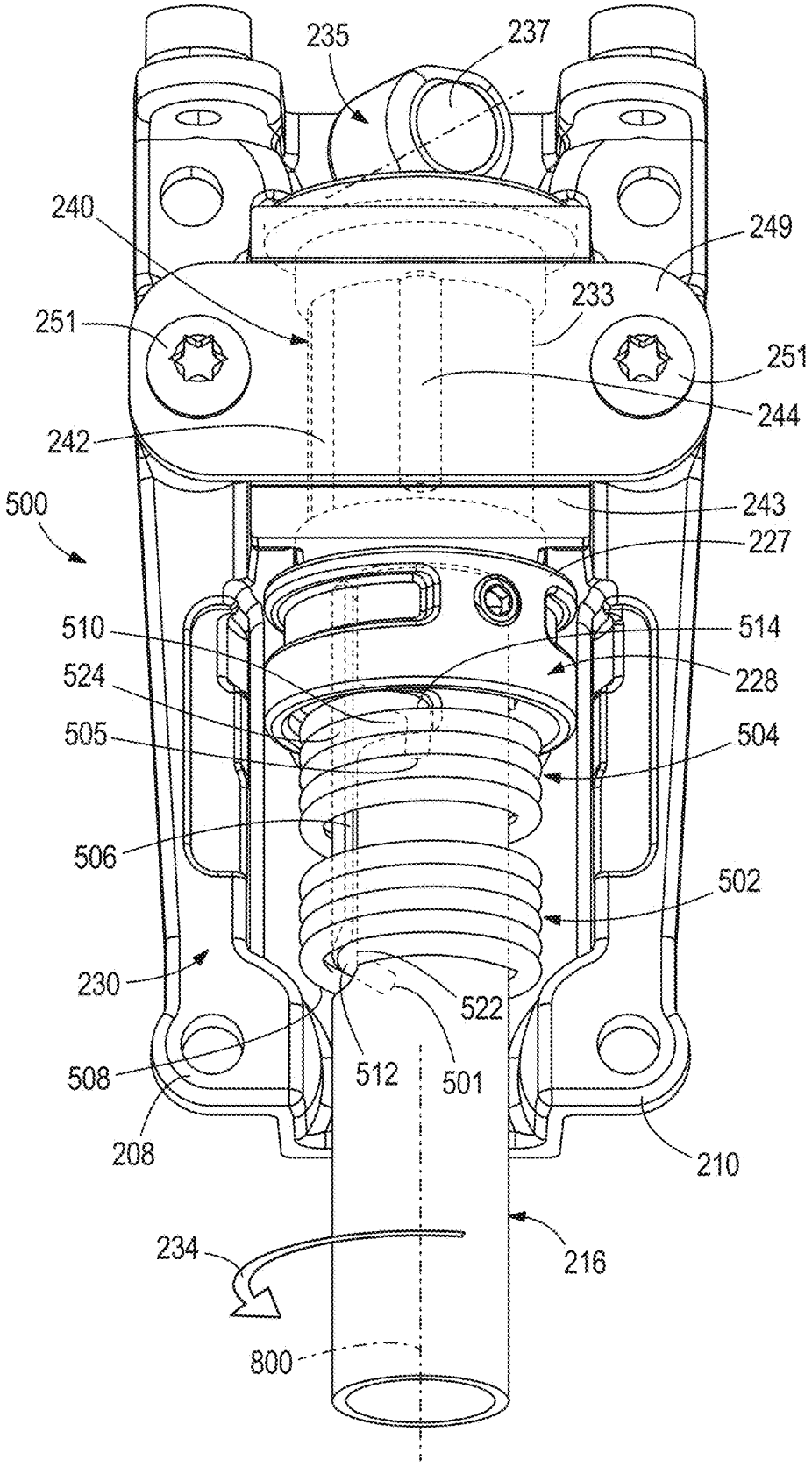
Figure 7:
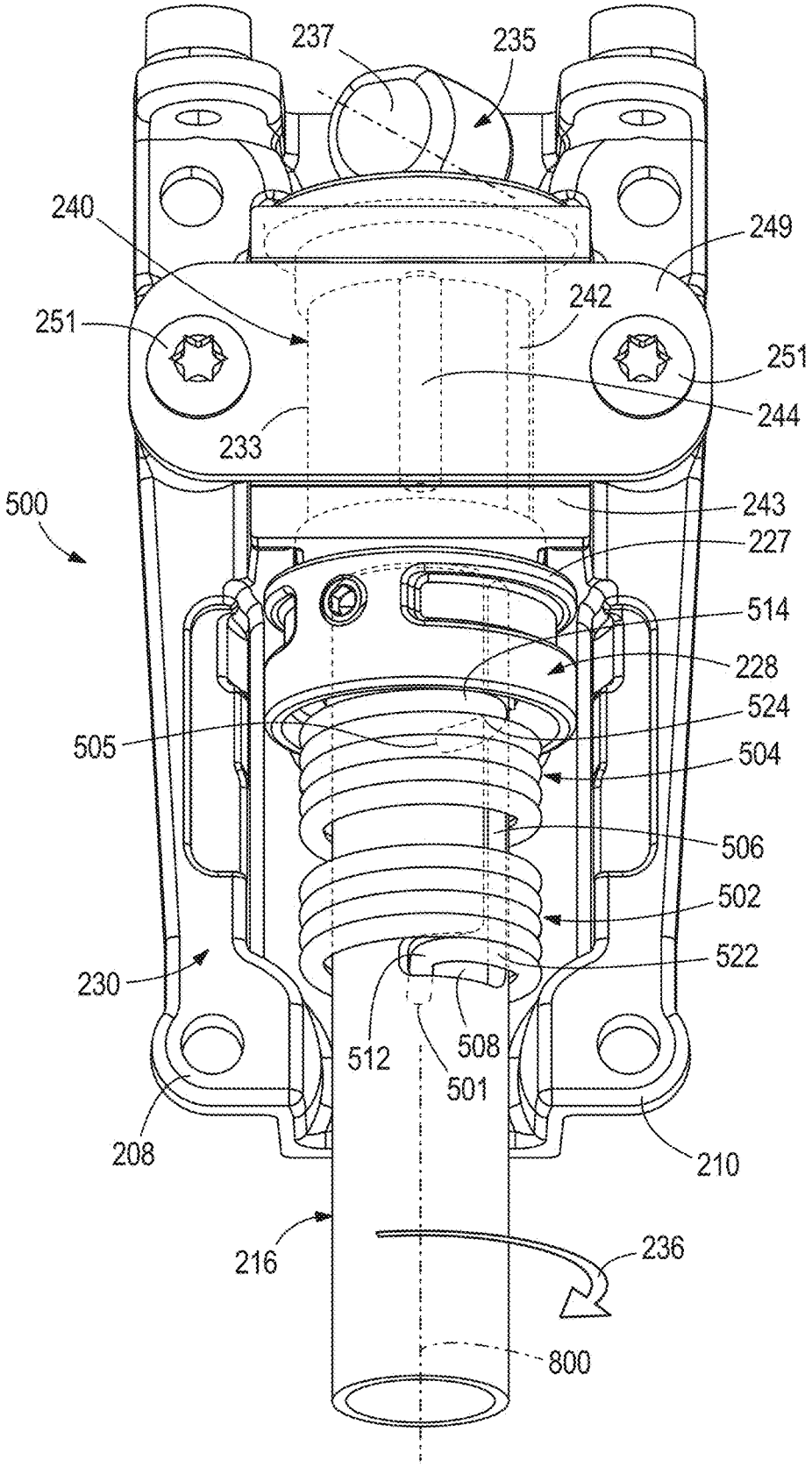

Referring to FIGS. 5-7, in use, a user seated on either the port side 208 or the starboard side 210 of the tiller arm 104 manually grasps and rotates the grip 220 out of the center position (FIG. 5). In conventional use, the grip 220 is rotated inwardly toward the body of the user, which in this case, can be in either the first direction 234 or the second direction 236, dependent upon the positioning and preference of the user. Shown in FIG. 5, in the center position, the first end 501 of the first torsion spring 502 and the first end 505 of the second torsion spring 504 are positioned within the engagement slot 506, each applying a substantially equal spring bias onto the shaft 216 in opposite directions.

Referring now to FIG. 6, when the grip 220 is rotated in the first direction 234, the first slot stop 522 is rotated into the hook 512 of the first torsion spring 502, thus winding the first torsion spring 502 and applying a spring bias onto the grip 220. As the grip 220 is rotated further from the center position, the spring bias increases proportionally. As the shaft 216 is rotated further into the first torsion spring 502, the first end 505 of the second torsion spring 504 passes within the second retaining slot 510 and is disengaged from the shaft 216. When the user releases the grip 220, the bias of the first torsion spring 502 rotates the grip 220 back towards the center position (FIG. 5).

Referring now to FIG. 7, when the grip 220 is rotated in the second direction 236, the second slot stop 524 is rotated into the hook 514 of the second torsion spring 504, thus winding the second torsion spring 504 and applying a spring bias onto the grip 220. As the grip 220 is rotated further from the center position, the spring bias increases proportionally to the increase in speed of the marine drive. As the shaft 216 is rotated further into the second torsion spring 504, the first end 501 of the first torsion spring 502 passes within the first retaining slot 508 and is disengaged from the shaft 216. When the user releases the grip 220, the bias of the second torsion spring 504 rotates the grip 220 back towards the center position (FIG. 5). As described above, in the illustrated example, the spring bias provided by the first and the second torsion springs 502, 504 is not great enough to overcome the engagement force between the roller pin 244 and the ramped surfaces 246. To return the grip 220 to the center position, it is necessary to apply manual rotational force on the shaft 216 via the grip 220 to bring the raised groove 242 into alignment with the roller pin 244.

Figure 8:
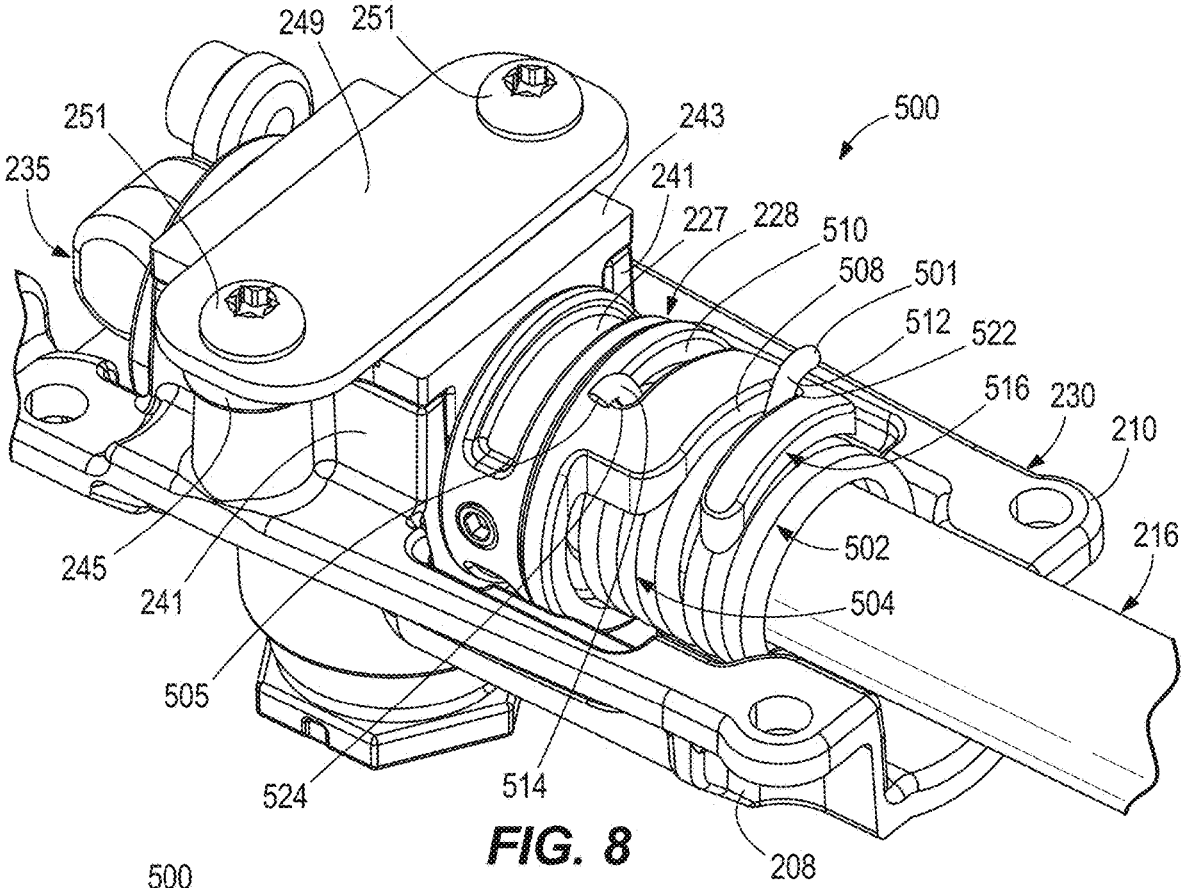
FIG. 8 is a perspective view of a return device of a second embodiment.
Figure 9:
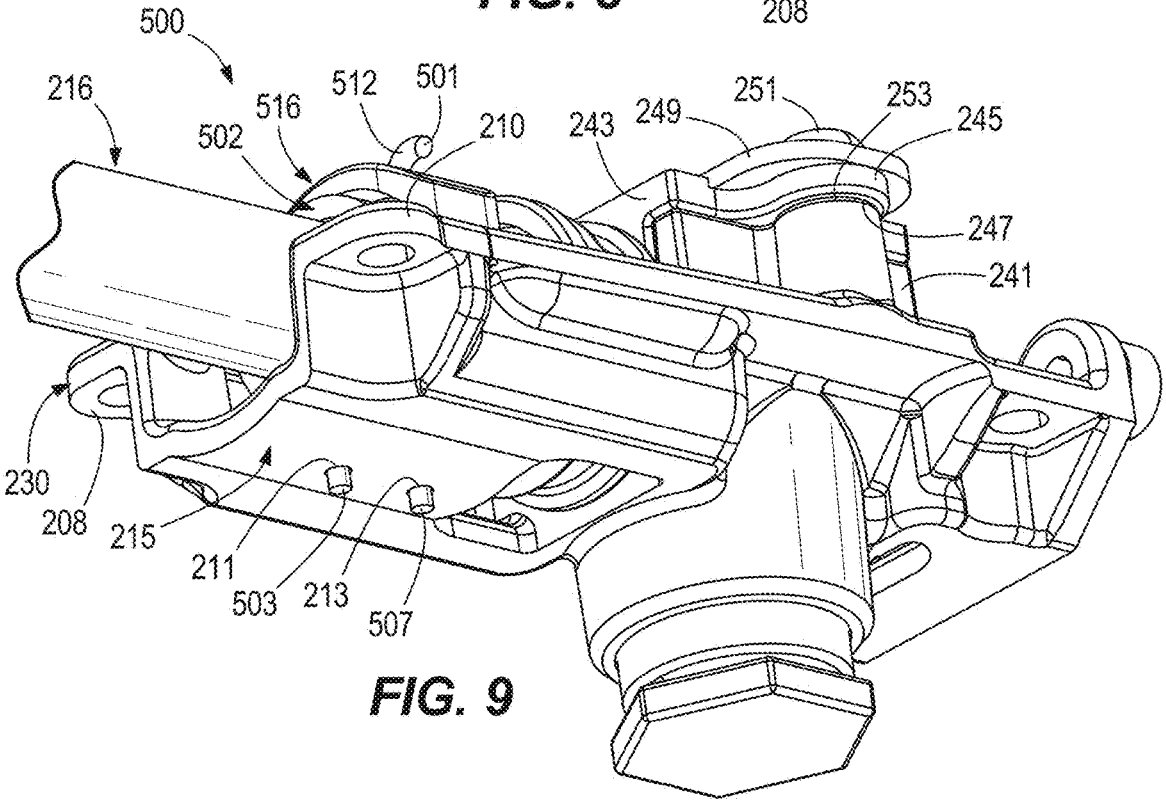
FIG. 9 is a perspective view of an underside of the return device of FIG. 8.
Figure 10:
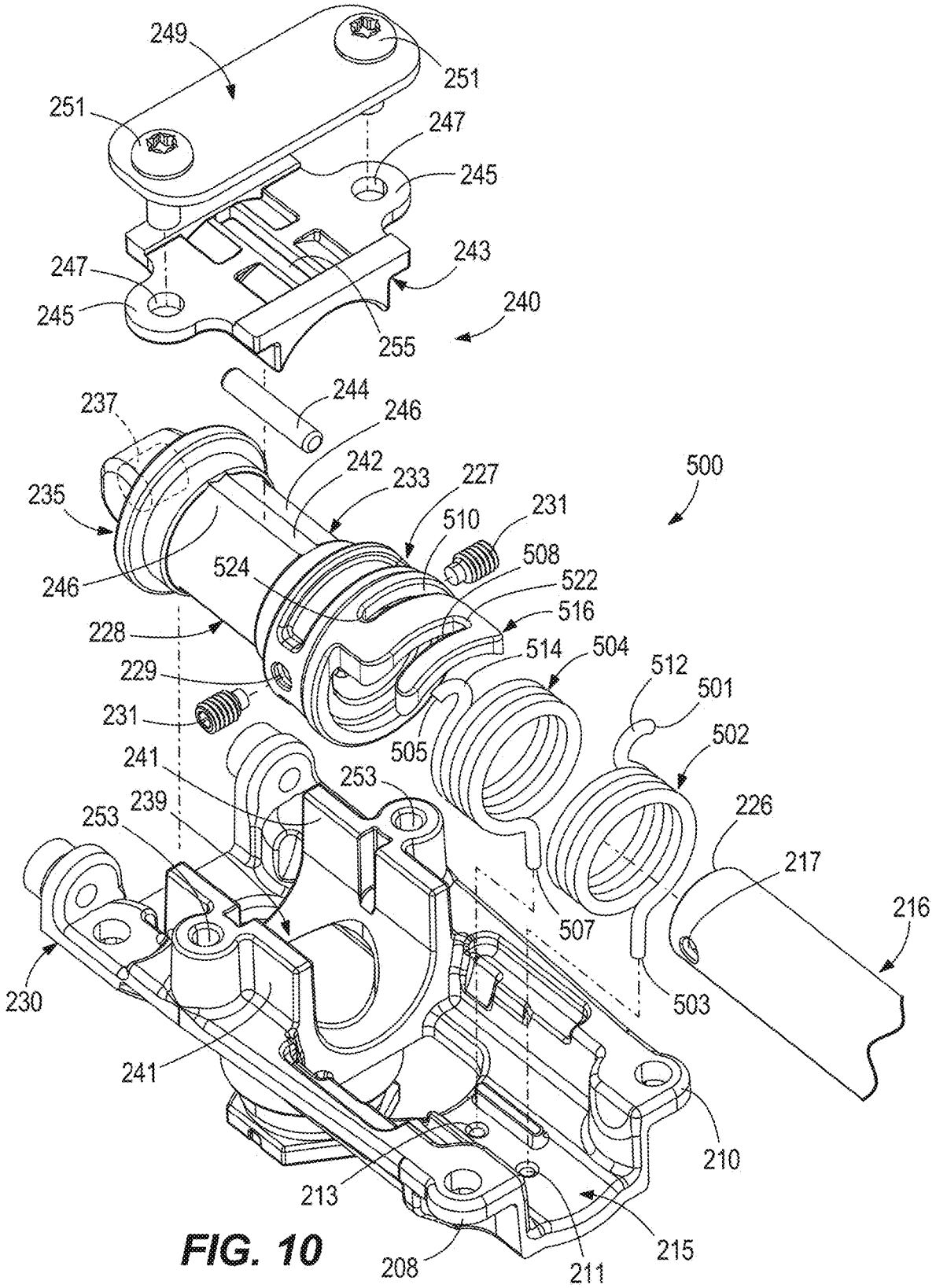
FIG. 10 is an exploded view of the return device of FIG. 8.

Referring to FIGS. 8-10, a second embodiment of the return device 500 is shown. The return device 500 includes a first and second torsion spring 502, 504 having a first and a second spring bias. The first and the second torsion springs 502, 504 are coupled to the supporting tray 230 and coupled to the grip 220 via the shaft extension 228. The first and the second torsion spring 502, 504 extend around the rear end 226 of the shaft 216 and are seated within and engage with a base plate 215 of the supporting tray 230, as shown in FIG. 9. Best shown in FIG. 10, the shaft extension 228 includes an engagement plate 516 which extends from the body 227 longitudinally forward towards the grip 220. The engagement plate 516 is curved and formed integrally with the body 227, although this configuration is not limiting. The engagement plate 516 has a first retaining slot 508 and a second retaining slot 510 for receiving the first and the second torsion springs 502, 504, respectively. The first and the second retaining slot 508, 510 are longitudinally offset from one another and extend inward from laterally opposing sides of the engagement plate 516. The first retaining slot 508 extends from the port side 208 of the engagement plate 516 partially inward such that an inner end constitutes a first slot stop 522 for engagement with the first torsion spring 502. The second retaining slot 510 extends from the starboard side 210 of the engagement plate 516 partially inward such that an inner end constitutes a second slot stop 524 for engagement with the second torsion spring 504, as will be described further herein. The first slot stop 522 and the second slot stop 524 are positioned on laterally opposed ends of the engagement plate 516 such that rotation of the grip 220 in either the first or the second direction 234, 236 engages only one of the first or the second slot stops 522, 524.

Referring to FIGS. 8-10, the first torsion spring 502 has a first end 501 which is bent upwardly within the first retaining slot 508 and forms a hook 512 which is rotatable into and out of engagement with the first slot stop 522. The first torsion spring 502 further has a second end 503 which extends downwardly into a first hole 211 within the base plate 215 of the supporting tray 230. The first torsion spring 502 is wound such that the first end 501 is positioned forwardly of the second end 503 with respect to the grip 220. The second torsion spring 504 is positioned rearwardly of the first torsion spring 502. The second torsion spring has a first end 505 which is bent upwardly within the second retaining slot 510 and forms a hook 514 which is rotatable into and out of engagement with the second slot stop 524. The second torsion spring 504 further has a second end 507 which extends into a second hole 213 within the base plate 215 adjacent the first hole 211. The second torsion spring 504 is wound such that the first end 505 is positioned rearwardly of the second end 507 with respect to the grip 220. As such, the first torsion spring 502 and the second torsion spring 504 are oppositely wound.

Figure 11:
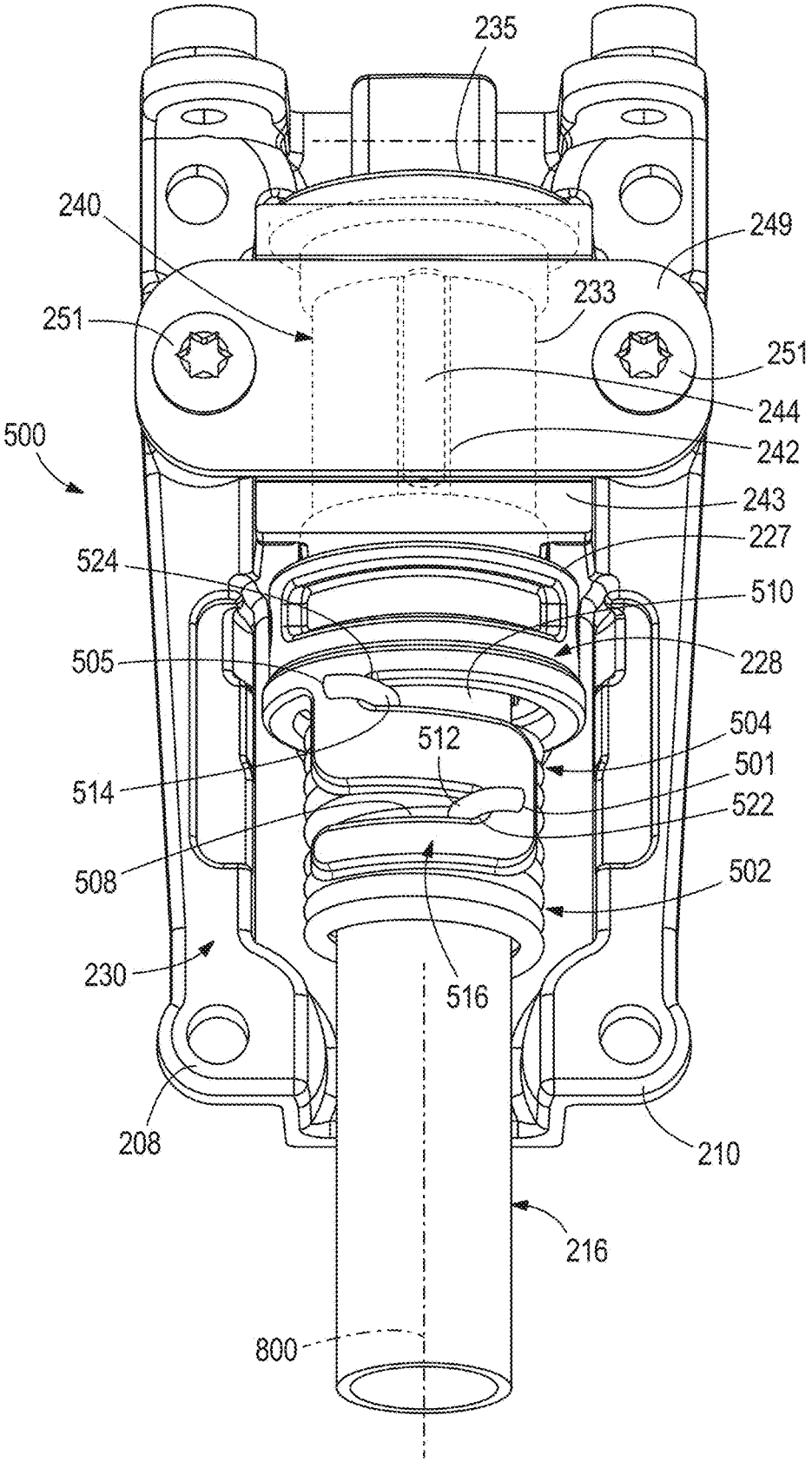
FIGS. 11-13 are overhead views of the return device of FIG. 8 partially in phantom.
Figure 12:
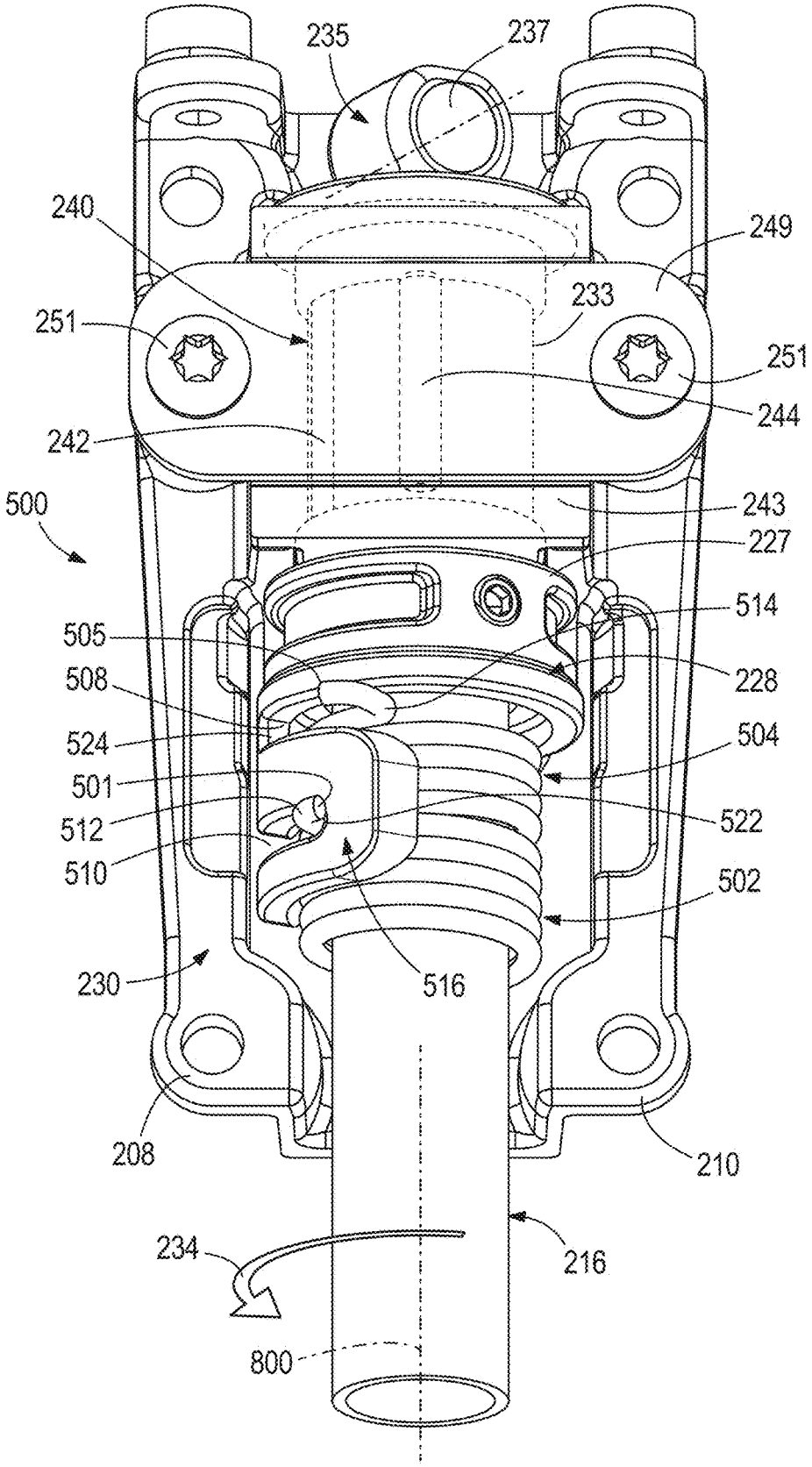
Figure 13:
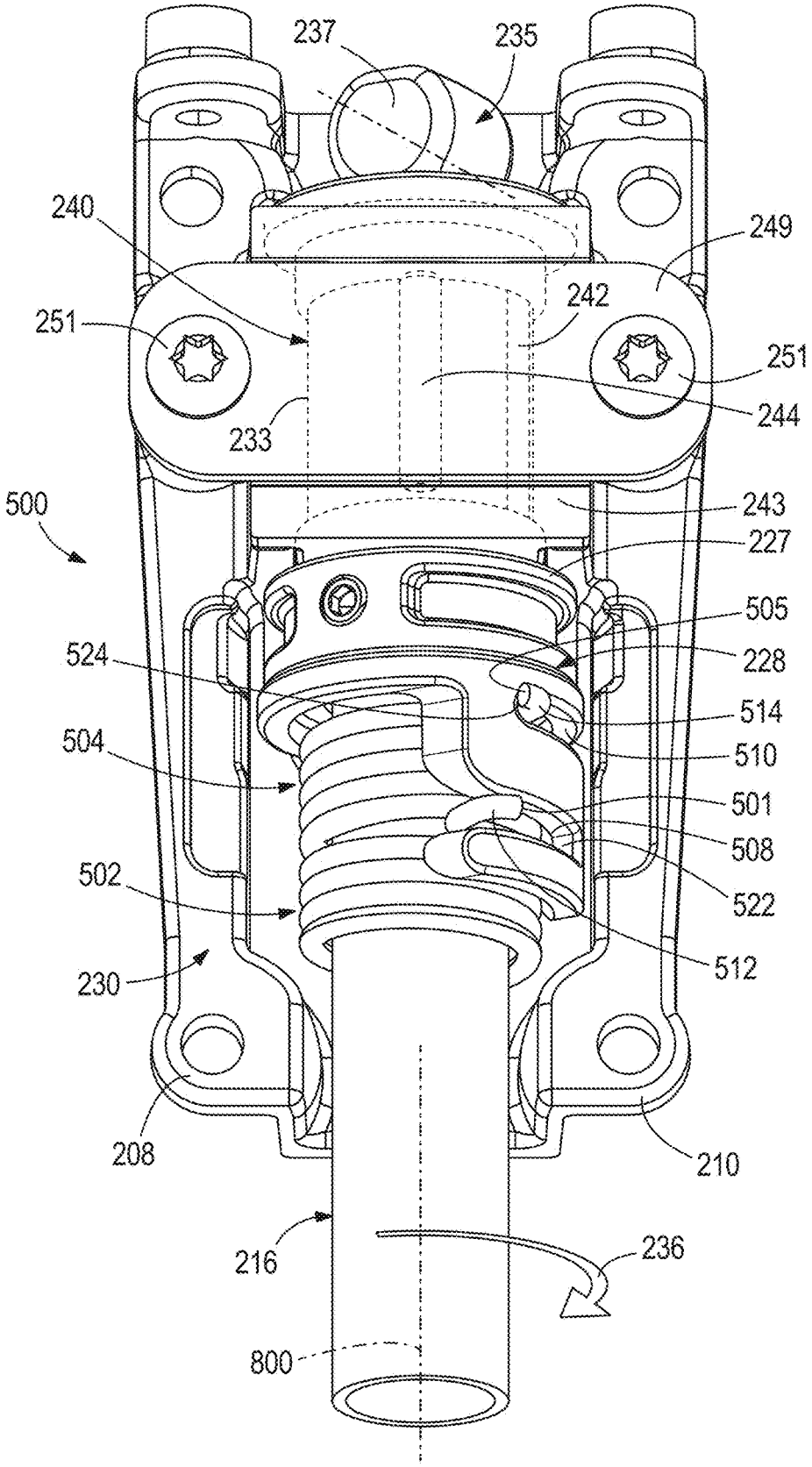

Referring to FIGS. 11-13, in use, the grip 220 is rotatable out of the center position (FIG. 11) in a first direction 234 (FIG. 12) and a second direction 236 (FIG. 13) opposite the first direction 234. Shown in FIG. 11, in the center position, the first end 501 of the first torsion spring 502 and the first end 505 of the second torsion spring 504 are engaged with the engagement plate 516 at inner ends of the first and the second retaining slots 508, 510, respectively, each applying substantially equal spring bias onto the engagement plate 516 in opposite directions.

Referring now to FIG. 12, when the grip 220 is rotated in the first direction 234, the first slot stop 522 is rotated into the hook 512 of the first torsion spring 502, thus winding the first torsion spring 502 and applying a spring bias onto the grip 220. As the grip 220 is rotated further from the center position, the spring bias increases proportionally to the increase in speed of the marine drive. As the engagement plate 516 is rotated further into the first torsion spring 502, the first end 505 of the second torsion spring 504 passes within the second retaining slot 510 and is disengaged from the engagement plate 516. When the user releases the grip 220, the bias of the first torsion spring 502 rotates the grip 220 back towards the center position (FIG. 11).

Referring now to FIG. 13, when the grip 220 is rotated in the second direction 236, the second slot stop 524 is rotated into the hook 514 of the second torsion spring 504, thus winding the second torsion spring 504 and applying a spring bias onto the grip 220. As the grip 220 is rotated further from the center position, the spring bias increases proportionally to the increase in speed of the marine drive. As the engagement plate 516 is rotated further into the second torsion spring 504, the first end 501 of the first torsion spring 502 passes within the first retaining slot 508 and is disengaged from the engagement plate 516. When the user releases the grip 220, the bias of the second torsion spring 504 rotates the grip 220 back towards the center position (FIG. 11).

Figure 14:
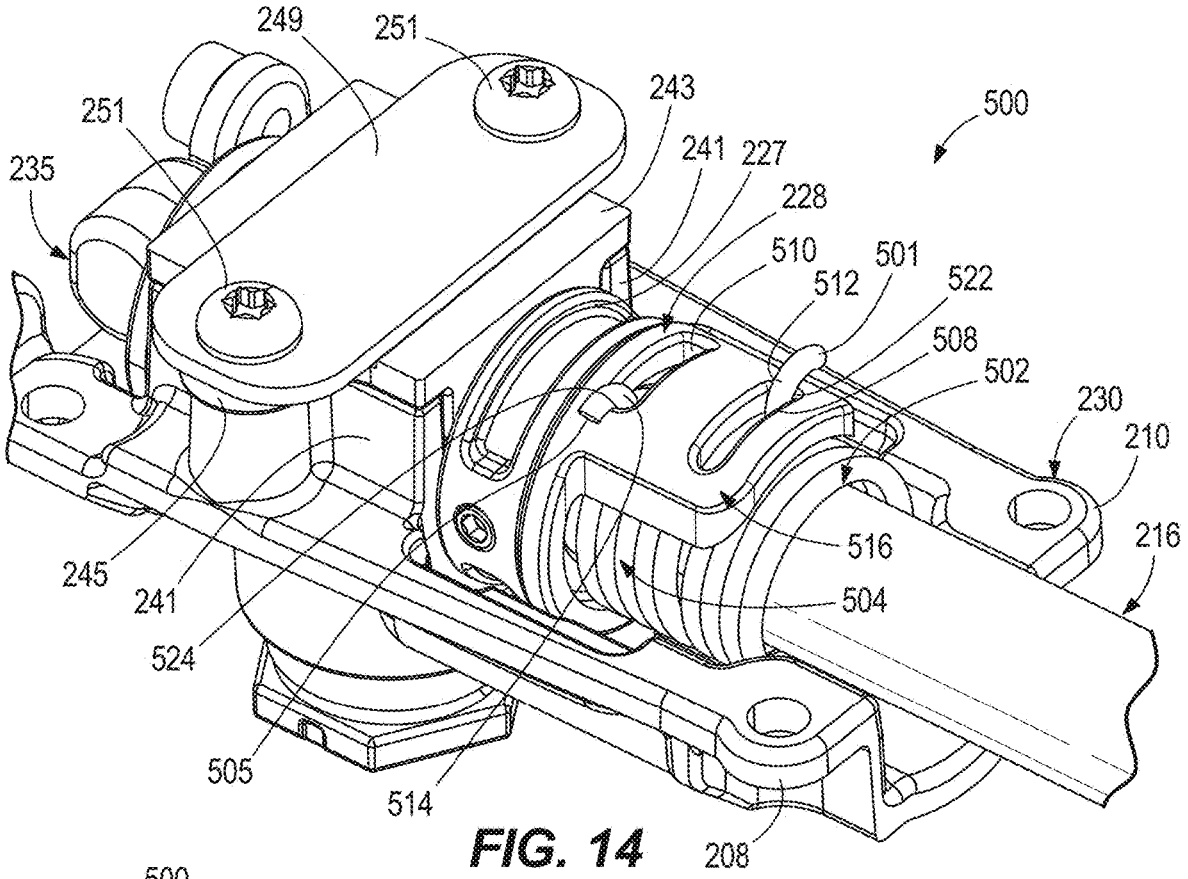
FIG. 14 is a perspective view of a return device of a third embodiment.
Figure 15:
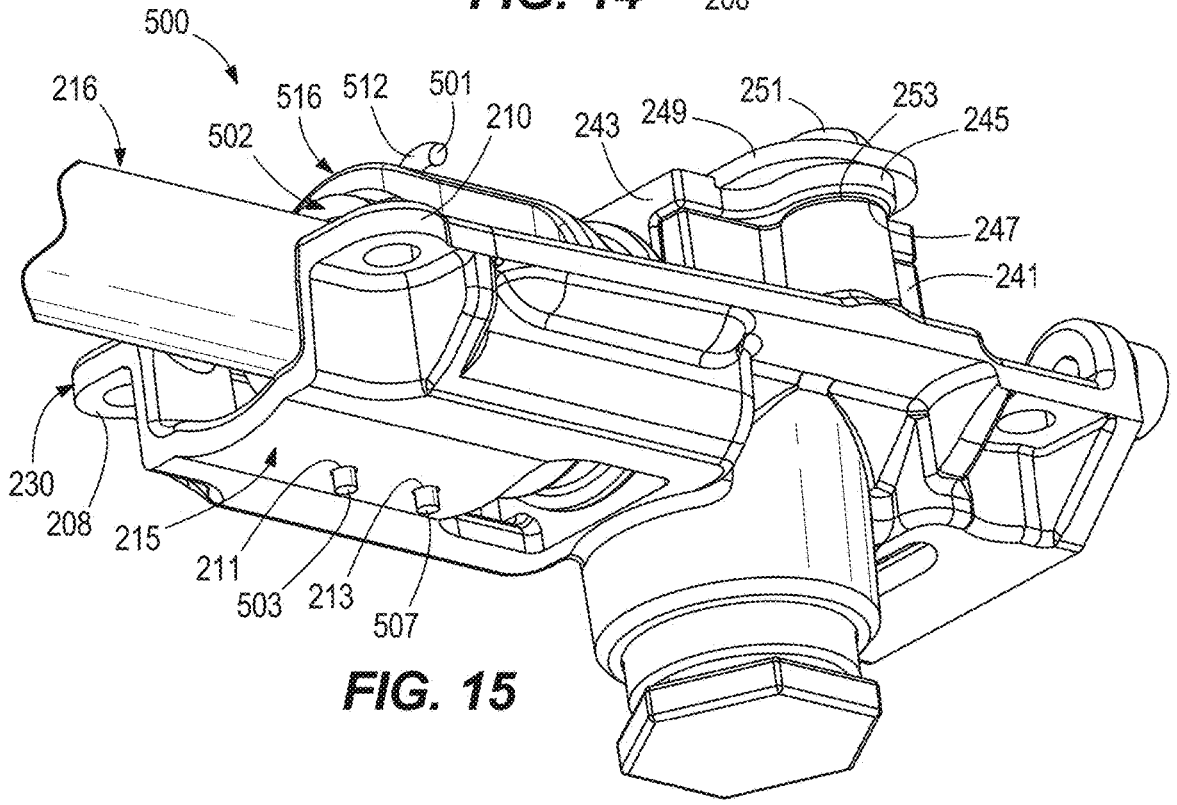
FIG. 15 is a perspective view of the underside of the return device of FIG. 14.
Figure 16:
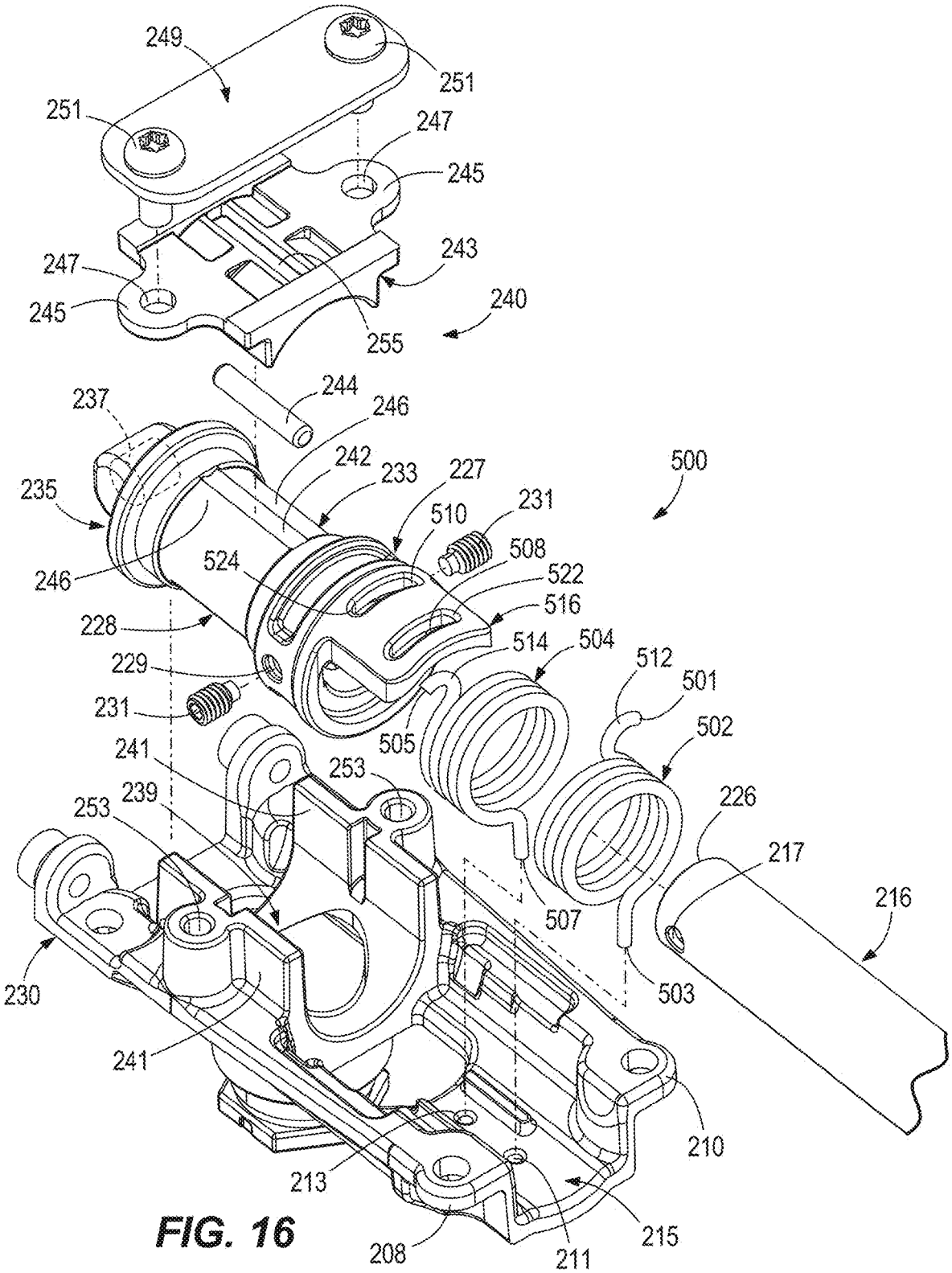
FIG. 16 is an exploded view of the return device of FIG. 14.

Referring to FIGS. 14-16, a third embodiment of the return device 500 is shown. The return device 500 includes a first and second torsion spring 502, 504 having a first and a second spring bias. As described in reference to the second embodiment, the first and the second torsion springs 502, 504 are coupled to the supporting tray 230 and coupled to the grip 220 via the shaft extension 228. The first and the second torsion spring 502, 504 extend around the rear end 226 of the shaft 216 and are seated within and engage with a base plate 215 of the supporting tray 230, as shown in FIG. 15. As described in reference to the second embodiment, the first torsion spring 502 is positioned forwardly of the second torsion spring 504 with respect to the grip 220. Further, the first and the second torsion springs 502, 504 are oppositely wound.

Best shown in FIG. 16, the shaft extension 228 includes an engagement plate 516 which extends from the body 227 longitudinally forward towards the grip 220. The engagement plate 516 is curved and formed integrally with the body 227, although this configuration is not limiting. Similar to the second embodiment, the engagement plate 516 has a first retaining slot 508 and a second retaining slot 510 for receiving the first and the second torsion springs 502, 504, respectively. The first retaining slot 508 and the second retaining slot 510 extend laterally along a middle portion of the engagement plate 516 and are longitudinally offset from one another. The first retaining slot 508 and the second retaining slot 510 are configured to engage the oppositely wound first and second torsion springs 502, 504. As such, the first retaining slot 508 has an end positioned on the port side 208 which constitutes a first slot stop 522 and the second retaining slot 510 has an end positioned on the starboard side 210 which constitutes a second slot stop 524. The first slot stop 508 is configured to engage the first torsion spring 502 and the second slot stop 510 is configured to engage the second torsion spring 504. The first slot stop 522 and the second slot stop 524 are positioned on laterally opposed ends of the engagement plate 516 such that rotation of the grip 220 in either the first or the second direction 234, 236 engages only one of the first or the second slot stops 522, 524.

As described in reference to the second embodiment, the first torsion spring 502 has a first end 501 which is bent upwardly within the first retaining slot 508 and forms a hook 512 which is rotatable into and out of engagement with the first slot stop 522. The first torsion spring 502 further has a second end 503 which extends downwardly into a first hole 211 within the base plate 215 of the supporting tray 230. The second torsion spring has a first end 505 which is bent upwardly within the second retaining slot 510 and forms a hook 514 which is rotatable into and out of engagement with the second slot stop 524. The second torsion spring 504 further has a second end 507 which extends into a second hole 213 within the base plate 215 adjacent the first hole 211.

Figure 17:
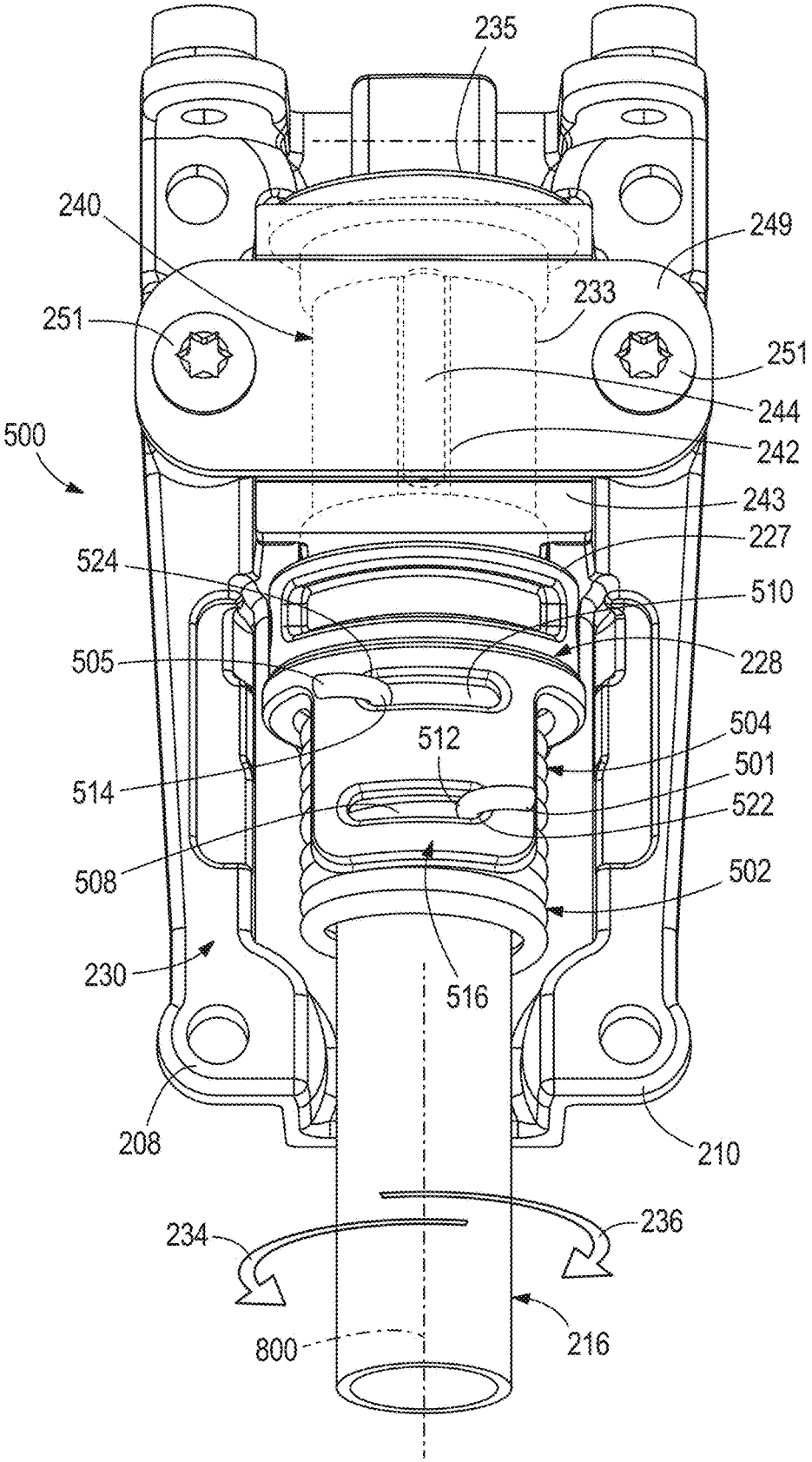
FIG. 17 is an overhead view of the return device of FIG. 14, partially in phantom.

Referring to FIG. 17, the grip 220 is rotatable out of the center position in a first direction 234 and a second direction 236 opposite the first direction 234. Shown in FIG. 17, in the center position, the hook 512 of the first torsion spring 502 is engaged with the first slot stop 522 and the hook 514 of the second torsion spring 504 is engaged with the second slot stop 524, each applying substantially equal spring bias onto the engagement plate 516 in opposite directions.

In use, rotation of the grip 220 rotates the engagement plate 516 into and out of engagement with the first and the second torsion springs 502, 504 in the same manner as described above in reference to the second embodiment. When the grip 220 is rotated in the first direction 234, the first slot stop 522 is rotated into the hook 512 of the first torsion spring 502, thus winding the first torsion spring 502 and disengaging the second torsion spring 504. When the grip 220 is rotated in the second direction 236, the second slot stop 524 is rotated into the hook 514 of the second torsion spring 504, thus winding the second torsion spring 504 and disengaging the first torsion spring 502. For further description of the engagement between the first and second torsion springs 502, 504 and the engagement plate 516, see the description provided above in reference to the second embodiment.

Figure 18:
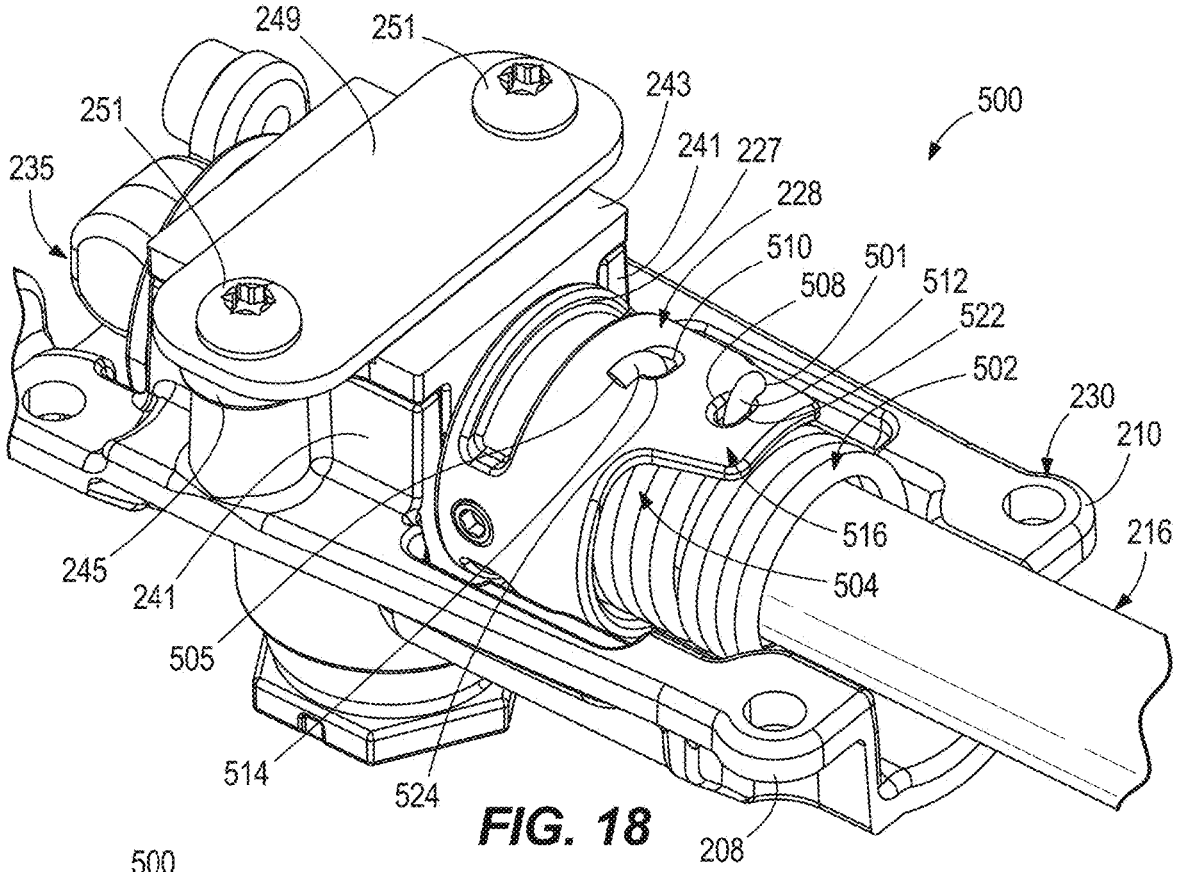
FIG. 18 is a perspective view of a return device of a fourth embodiment.
Figure 19:
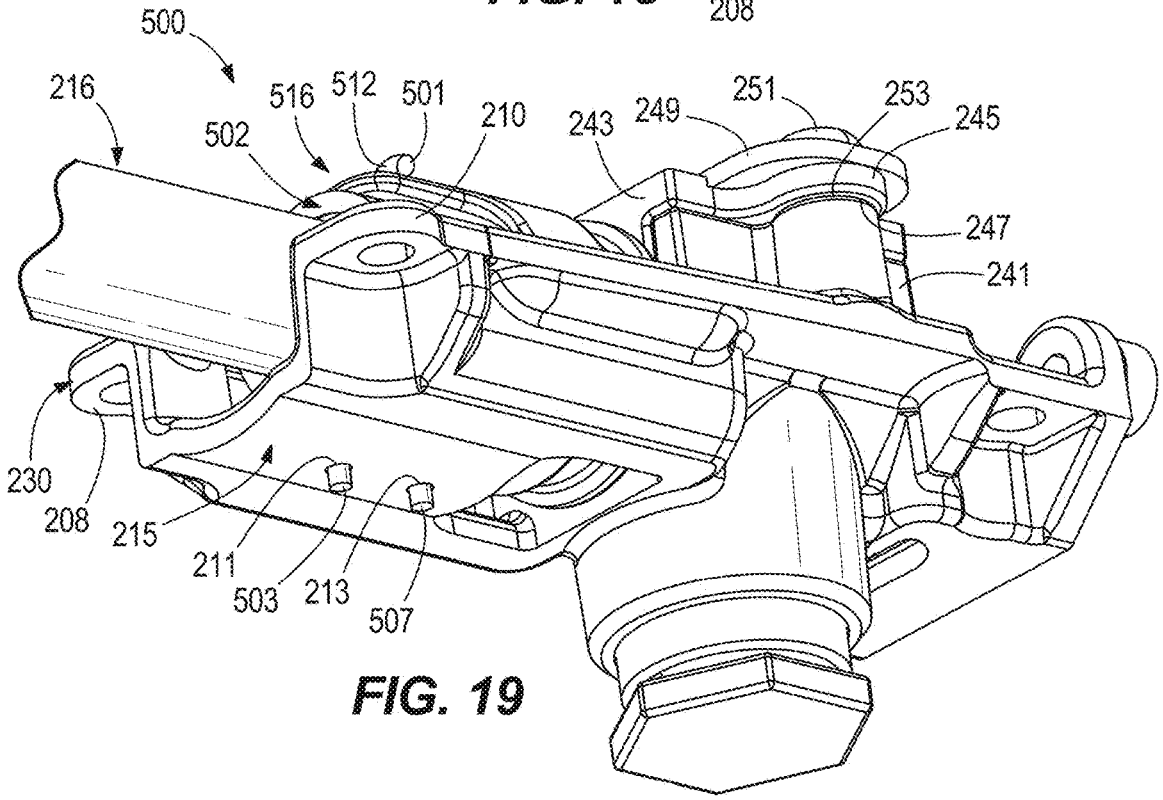
FIG. 19 is a perspective view of the underside of the return device of FIG. 18.
Figure 20:
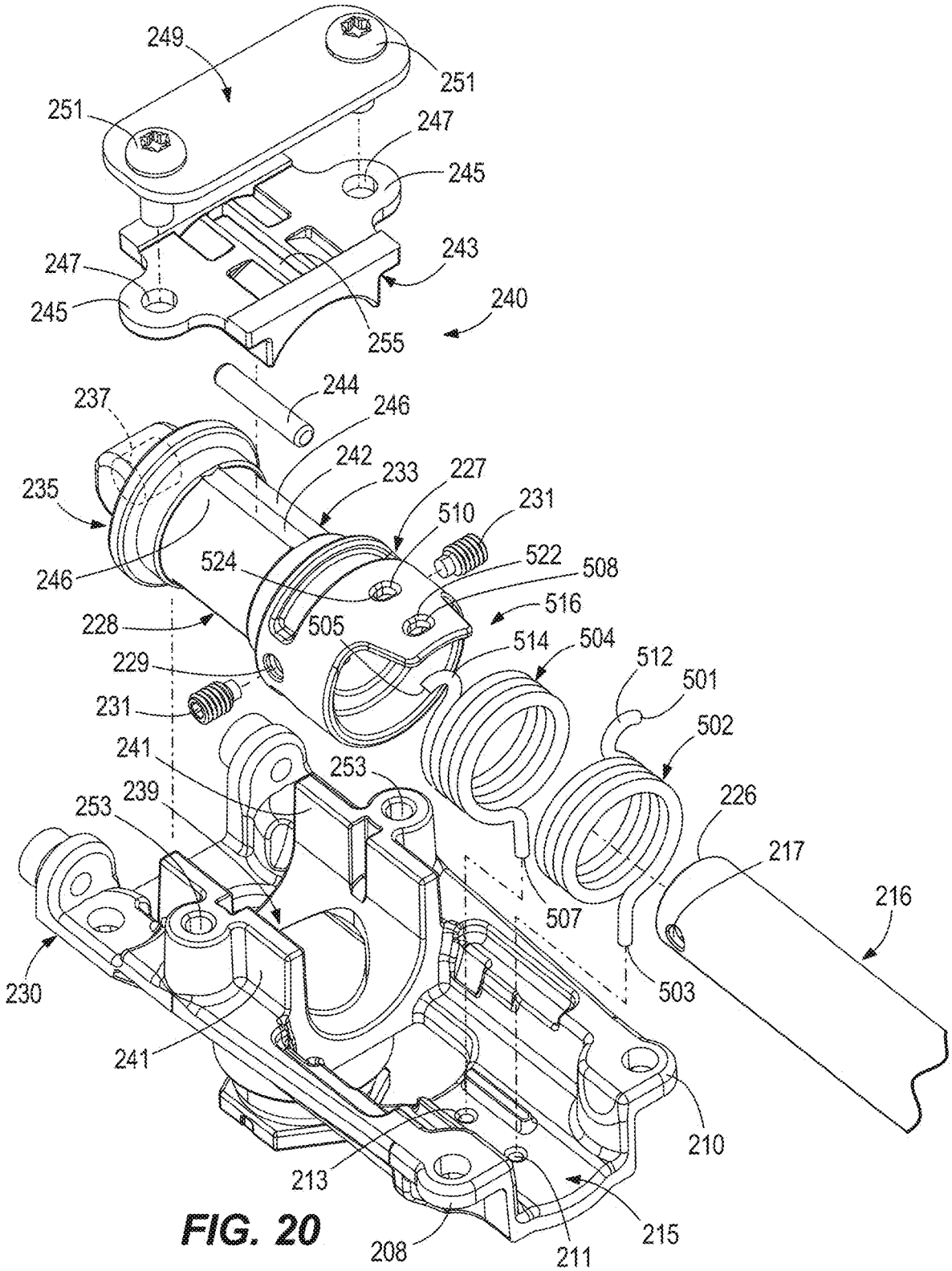
FIG. 20 is an exploded view of the return device of FIG. 18.

Referring now to FIGS. 18-20, a fourth embodiment of the return device 500 is shown. The return device 500 includes 500 includes a first and second torsion spring 502, 504 having a first and a second spring bias. As described in reference to the second and third embodiment, the first and the second torsion springs 502, 504 are coupled to the supporting tray 230 and coupled to the grip 220 via the shaft extension 228. The first and the second torsion spring 502, 504 extend around the rear end 226 of the shaft 216 and are seated within and engage with a base plate 215 of the supporting tray 230, as shown in FIG. 19. As described in reference to the second embodiment, the first torsion spring 502 is positioned forwardly of the second torsion spring 504 with respect to the grip 220. Further, the first and the second torsion springs 502, 504 are oppositely wound.

Best shown in FIG. 20, the shaft extension 228 includes an engagement plate 516 which extends from the body 227 longitudinally forward towards the grip 220. The engagement plate 516 is curved and formed integrally with the body 227, although this configuration is not limiting. The engagement plate 516 has a first retaining slot 508 and a second retaining slot 510 which are substantially circular and configured for receiving the first and the second torsion springs 502, 504, respectively. The first retaining slot 508 and the second retaining slot 510 are aligned along a middle portion of the engagement plate 516 and are longitudinally offset from one another. The first retaining slot 508 and the second retaining slot 510 are configured to engage the oppositely wound first and second torsion springs 502, 504. As such, the first retaining slot 508 has an end on the port side 208 which constitutes a first slot stop 522 and the second retaining slot 510 has an end on the starboard side 210 which constitutes a second slot stop 524. The first slot stop 508 is configured to engage the first torsion spring 502 and the second slot stop 510 is configured to engage the second torsion spring 504. The first slot stop 522 and the second slot stop 524 are configured such that rotation of the grip 220 in either the first or the second direction 234, 236 engages only one of the first or the second slot stops 522, 524.

Figure 21:
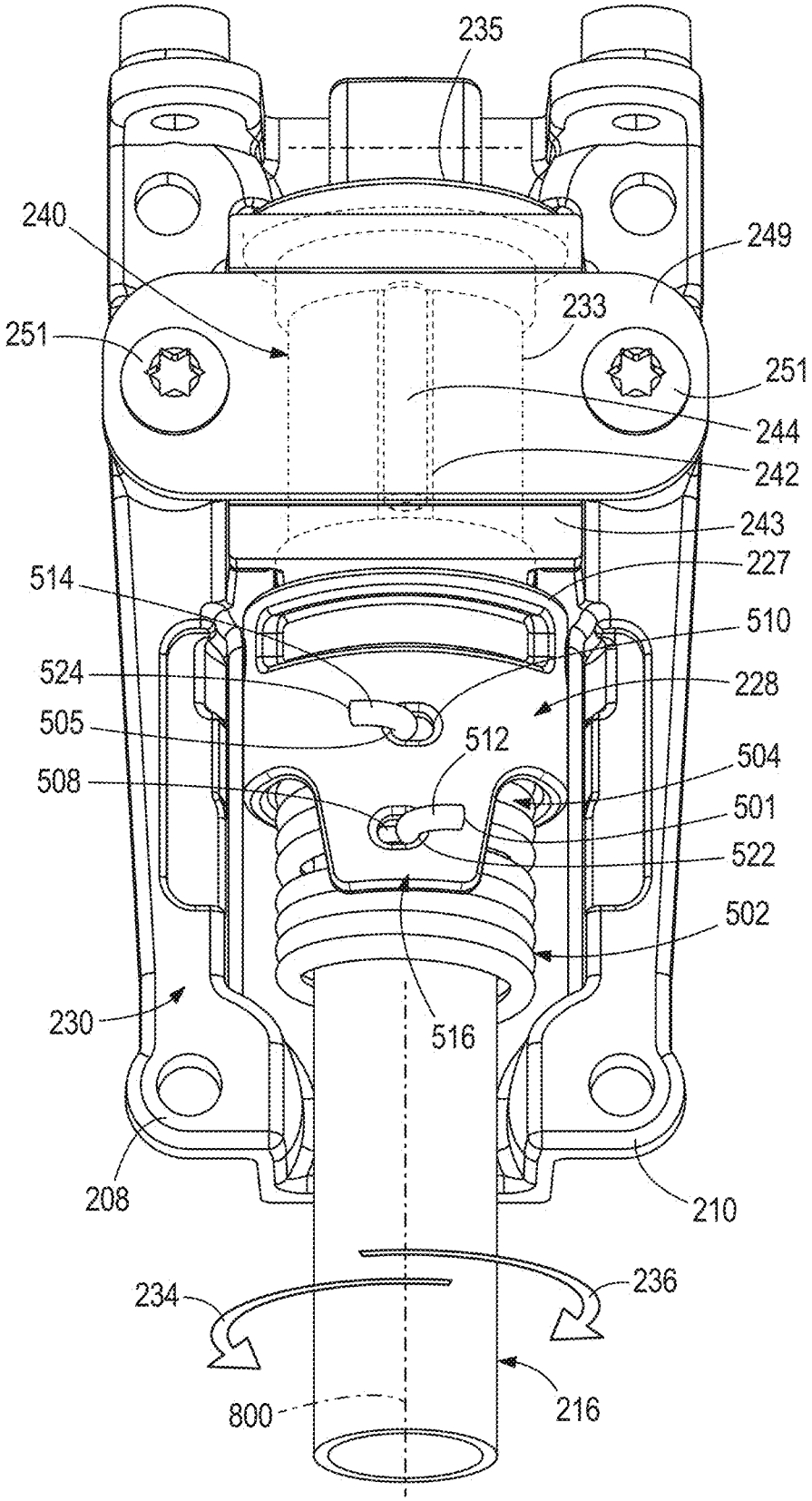
FIG. 21 is an overhead view of the return device of FIG. 18, partially in phantom.

Referring to FIG. 21, the grip 220 is rotatable out of the center position in a first direction 234 and a second direction 236 opposite the first direction 234. Shown in FIG. 21, in the center position, the first end 501 of the first torsion spring 502 and the first end 505 of the second torsion spring 504 are engaged with the engagement plate 516 each applying substantially equal spring bias onto the engagement plate 516 in opposite directions.

When the grip 220 is rotated in the first direction 234, the first slot stop 522 is rotated into the hook 512 of the first torsion spring 502, thus winding the first torsion spring 502 and unwinding the second torsion spring 504. When the grip 220 is rotated in the second direction 236, the second slot stop 524 is rotated into the hook 514 of the second torsion spring 504, thus winding the second torsion spring 504 and unwinding the first torsion spring 502. For further description of the engagement between the first and second torsion springs 502, 504 and the engagement plate 516, see the description provided above in reference to the second embodiment.

Figure 22:
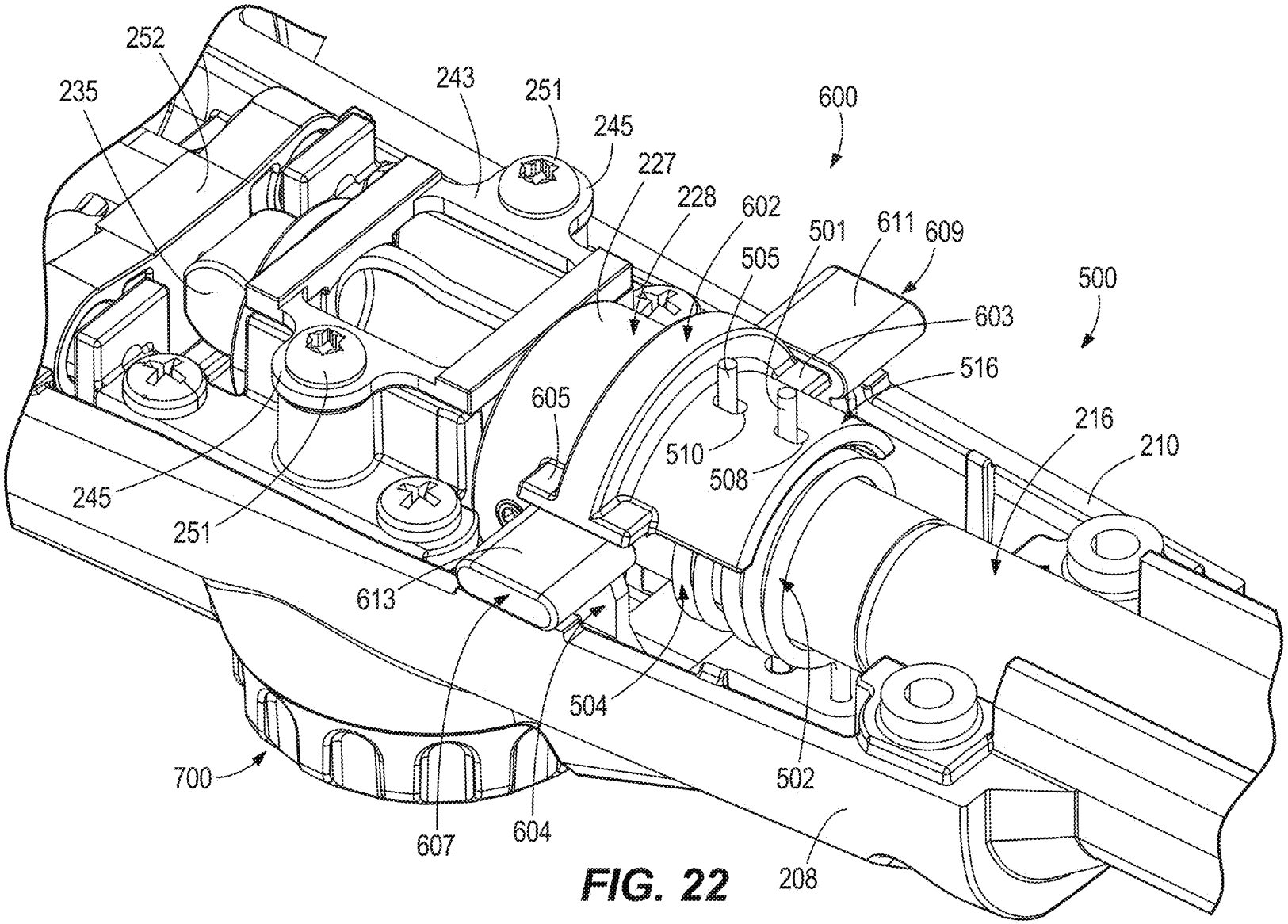
FIG. 22 is a perspective view of a return device of a fifth embodiment, illustrating a grip restraining device.
Figure 23:
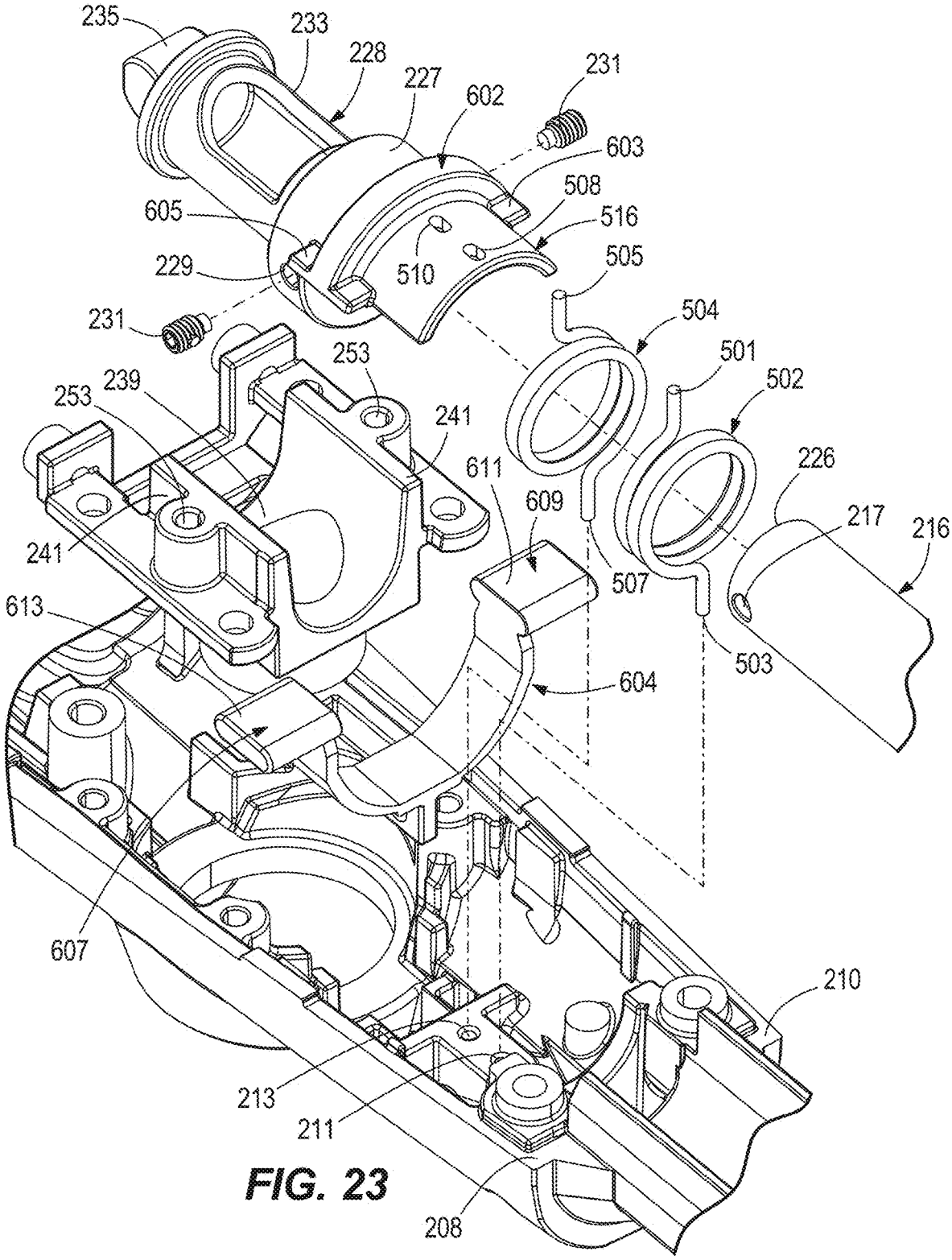
FIG. 23 is an exploded view of the return device of FIG. 22.
Figure 24:
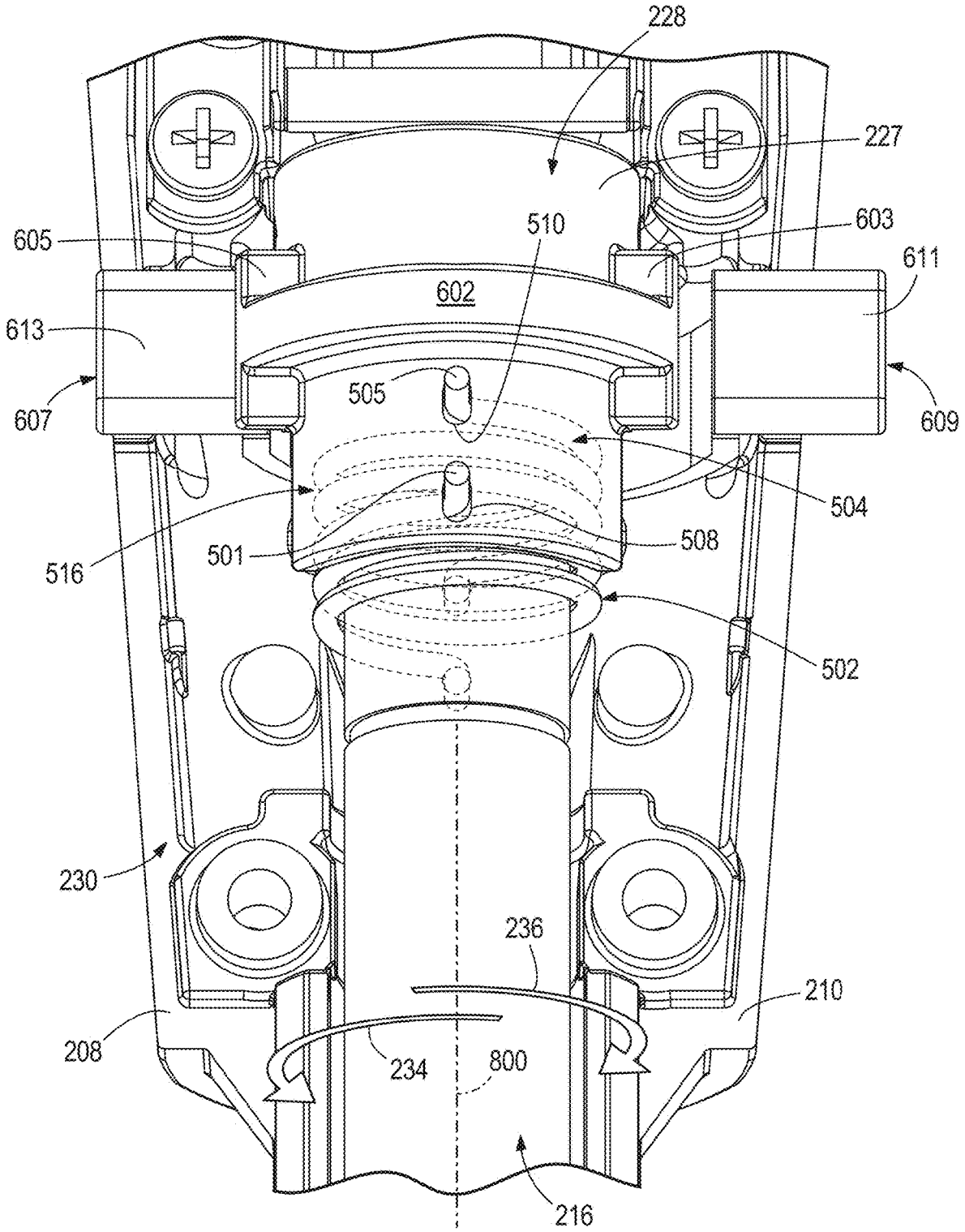
FIG. 24 is an overhead view of the return device of FIG. 22, partially in phantom.

Referring now to FIGS. 22-24, a fifth embodiment of the return device 500 is shown. The return device 500 includes a first and second torsion spring 502, 504 having a first and a second spring bias and a switching device 600 configured to selectively limit the rotation of the grip 220 into only one of the first direction 234 and the second direction 236, shown in FIG. 24. A grip restraining device 700 is further shown in FIG. 22 which is configured to increase the restraining force or resistance to manual rotation of the grip 220. Further description of an example of a grip restraining device such as what is shown in the drawings is presented in U.S. Patent Application No. 2023/0257092, which is incorporated by reference herein.

Referring still to FIGS. 22-24, the first and the second torsion springs 502, 504 are coupled to the supporting tray 230 and coupled to the grip 220 via the shaft extension 228. The first and the second torsion spring 502, 504 extend around the rear end 226 of the shaft 216 and are seated within and engage with a base plate 215 of the supporting tray 230. As described in reference to the second embodiment, the first torsion spring 502 is positioned forwardly of the second torsion spring 504 with respect to the grip 220. Further, the first and the second torsion springs 502, 504 are oppositely wound.

Best shown in FIG. 23, the shaft extension 228 includes an engagement plate 516 having a first and second retaining hole 508, 510 for engagement with the first and the second torsion spring 502, 504, respectively. Further, the shaft extension 228 includes a semi-annular rib 602 including a first and a second stopper 603, 605 on radially opposed ends. The semi-annular rib 602 engages with a U-shaped shuttle 604 positioned within the chassis 212 to form the switching device 600. The shuttle 604 has first and second engagement flanges 607, 609 connected by a semi-circular elongated member 608 defining a rotational area within which the engagement plate 516 is rotated. The first and second engagement flanges 607, 609 extend laterally outwardly from the chassis 212 and are configured to be manually actuated by a user. The first and second engagement flanges each include an upper face 611, 613, respectively which are configured to be brought into and out of engagement with the first and second stopper 603, 605 of the shaft extension 228. The shuttle 604 is moveable into a left-hand switch position to permit rotation in the first direction 234 and a right-hand switch position to permit rotation in the second direction 236, in particular wherein in each mode the grip 220 is only rotatable downwardly out of the center position, towards the user.

To engage the left-hand mode, the user manually presses the second engagement flange 609 radially inwards toward the shaft 216. This slides the shuttle 604 toward the opposite side of the chassis 212, which moves the second stopper 605 into alignment with the second engagement flange 609 and the first stopper 603 out of alignment with the first engagement flange 607. As such, the grip 220 is rotatable in the first direction 234 such that the shaft extension 228 and the first stopper 603 move within the rotational area. When the grip 220 is rotated in the first direction 234, the engagement plate 516 is rotated into engagement with first end 501 of the first torsion spring 502, thus winding the first torsion spring 502 and applying a spring bias onto the grip 220, as described in reference to the fourth embodiment. Rotation of the grip 220 in the second direction 236 brings the second stopper 605 into engagement with the upper face 613 of the second engagement flange 609, thus preventing rotation past the center position in the second direction 236.

To engage the right-hand mode, shown in FIG. 24, the user manually presses the first engagement flange 607 radially inwards toward the shaft 216. This slides the elongated member 608 toward the opposite side of the chassis 212, which moves the first stopper 603 into alignment with the first engagement flange 607 and the second stopper 605 out of alignment with the second engagement flange 609. As such, the grip 220 is rotatable in the second direction 236 such that the shaft extension 228 and the second stopper 605 move within the rotational area. When the grip 220 is rotated in the second direction 236, the engagement plate 516 is rotated into engagement with the first end 505 of the second torsion spring 504, thus winding the second torsion spring 504 and applying a spring bias onto the grip 220, as described in reference to the fourth embodiment. Rotation of the grip 220 in the first direction 234 brings the first stopper 603 into engagement with the upper face 611 of the first engagement flange 607, thus preventing rotation past the center position in the second direction 236.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A tiller for controlling speed of a marine vessel, the tiller comprising:

a tiller arm, and a grip which is rotatable relative to the tiller arm for controlling at least one operational characteristic of the marine vessel, the grip being rotatable away from a center position in a first direction and in an opposite, second direction, and a return device which biases the grip back towards the center position in both the first direction and the second direction.

2. The tiller according to claim 1, wherein the return device comprises a first spring configured to bias the grip opposite the first direction, and a second spring configured to bias the grip opposite the second direction.

3. The tiller according to claim 2, wherein the first spring and the second spring are separate components.

4. The tiller according to claim 1, wherein the return device comprises a first spring configured to apply a first spring bias on the grip as the grip is rotated from the center position in the first direction but to not apply the first spring bias on the grip as the grip is rotated from the center position in the second direction, and a second spring configured to apply a second spring bias on the grip as the grip is rotated from the center position in the second direction but to not apply the second spring bias on the grip as the grip is rotated from the center position in the first direction.

5. The tiller according to claim 1, wherein the return device comprises a first spring configured to rotate the grip towards the center position opposite the first direction, and a second spring configured to rotate the grip towards the center position opposite the second direction.

6. The tiller according to claim 5, wherein the first spring and the second spring have ends coupled to the grip and to the tiller arm, respectively.

7. The tiller according to claim 5, wherein rotating the grip away from the center position in the first direction winds the first spring but not the second spring, and wherein rotating the grip away from the center position in the second direction winds the second spring but not the first spring.

8. The tiller according to claim 5, wherein the first spring comprises a first end coupled to the grip and a second end coupled to the tiller arm, and wherein the second spring comprises a first end coupled to the grip and a second end coupled to the tiller arm.

9. The tiller according to claim 1, wherein the return device comprises a first spring coupled to one of the grip and the tiller arm via a slot which engages the first spring when the grip is rotated away from the center position in the first direction but which disengages from the first spring when the grip is rotated away from the center position in the second direction, and further wherein the return device comprises a second spring coupled to one of the grip and the tiller arm via a slot which engages the second spring when the grip is rotated away from the center position in the second direction but which disengages from the second spring when the grip is rotated away from the center position in the first direction.

10. The tiller according to claim 9, the grip is coupled to an elongated member extending in the tiller arm such that rotation of the grip causes rotation of the elongated member, and wherein the first spring and the second spring are coupled to the elongated member and to the tiller arm.

11. The tiller according to claim 1, wherein the return device is configured to increase a first spring bias on the grip as the grip is rotated in the first direction, and wherein the return device is configured to increase a second spring bias on the grip as the grip is rotated in the second direction, and wherein the first spring bias and the second spring bias are proportionally equal.

12. The tiller according to claim 1, wherein the return device comprises a dual counter-acting spring device.

13. A tiller for controlling speed of a marine vessel, the tiller comprising:

a tiller arm, a manually-operable member which is movable relative to the tiller arm for controlling at least one operational characteristic of the marine vessel, the manually-operable member being movable away from a center position in a first direction and in an opposite, second direction, and a return device which biases the manually-operable member back towards the center position in both the first direction and the second direction.

14. The tiller according to claim 13, wherein the manually-operable member comprises a grip.

15. The tiller according to claim 14, wherein the return device comprises a first spring configured to bias the grip opposite the first direction, and a second spring configured to rotate the grip opposite the second direction.

16. The tiller according to claim 13, wherein the return device comprises a first spring configured to rotate the manually-operable member towards the center position opposite the first direction, and a second spring configured to rotate the manually-operable member towards the center position opposite the second direction.

17. The tiller according to claim 16, wherein rotating the manually-operable member away from the center position in the first direction winds the first spring but not the second spring, and wherein rotating the manually-operable member away from the center position in the second direction winds the second spring but not the first spring.

18. The tiller according to claim 16, wherein the first spring is coupled to one of the manually-operable member and the tiller arm via a slot which engages the first spring when the manually-operable member is rotated away from the center position in the first direction but which disengages from the first spring when the manually-operable member is rotated away from the center position in the second direction, and further wherein the second spring is coupled to one of the manually-operable member and the tiller arm via a slot which engages the second spring when the manually-operable member is rotated away from the center position in the second direction but which disengages from the second spring when the manually-operable member is rotated away from the center position in the first direction.

19. The tiller according to claim 13, wherein the return device is configured to increase a first spring bias on the manually-operable member as the manually-operable member is rotated in the first direction, and wherein the return device is configured to increase a second spring bias on the manually-operable member as the manually-operable member is rotated in the second direction, and wherein the first spring bias and the second spring bias are proportionally equal.

20. The tiller according to claim 13, wherein the return device comprises a dual counter-acting spring device.

* * * * *